US009441392B2

(12) United States Patent
Whittemore

(10) Patent No.: US 9,441,392 B2
(45) **Date of Patent: *Sep. 13, 2016**

(54) PARTITION MOUNT WITH INTEGRATED PLUNGER ASSEMBLY

(71) Applicant: Zipwall, LLC, Arlington, MA (US)

(72) Inventor: Jeffrey P. Whittemore, Arllington, MA (US)

(73) Assignee: Zipwall LLC., Arlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/482,620

(22) Filed: Sep. 10, 2014

(65) Prior Publication Data

US 2015/0052843 A1 Feb. 26, 2015

Related U.S. Application Data

(63) Continuation of application No. 13/746,845, filed on Jan. 22, 2013, now Pat. No. 8,857,499, which is a continuation of application No. 13/288,394, filed on Nov. 3, 2011, now Pat. No. 8,371,360, which is a (Continued)

(51) Int. Cl.

| | |
|---|---|
| ***E04G 21/24*** | (2006.01) |
| ***E04H 12/18*** | (2006.01) |
| ***E04G 21/30*** | (2006.01) |

(Continued)

(52) U.S. Cl.

CPC ..... *E04H 12/182* (2013.01); *A47H 1/022* (2013.01); *A47H 13/00* (2013.01); *E04G 21/24* (2013.01); *E04G 21/243* (2013.01); *E04G 21/26* (2013.01); *E04G 21/30* (2013.01)

(58) Field of Classification Search

CPC ..... E04G 21/243

USPC ..... 160/368.1, 351; 16/429; 294/175, 182, 294/190, 191, 210

See application file for complete search history.

(56) References Cited

U.S. PATENT DOCUMENTS

| | | | |
|---|---|---|---|
| 642,236 | A | 1/1900 | Larimer |
| 827,000 | A | 7/1906 | Dinsmore |

(Continued)

FOREIGN PATENT DOCUMENTS

| | | |
|---|---|---|
| DE | 3918516 | 6/1989 |
| DE | 4420849 | 12/1995 |

(Continued)

OTHER PUBLICATIONS

"QUICKPROP", Brochure by Protecta Screen LTD, Aug. 1996.
"Third Hand", Brochure by FastCap, LLP, 2003.0.
"Curtain-Wall", Brochure by Curtain-Wall.com, Feb. 2000.
Mllx Co., Ltd. "Magic Wall". http:/www1.mllx.co.jp/.
"Mr. Long Arm", Brochure by Mr. LongArm, Inc., 2004.

(Continued)

*Primary Examiner* — David Purol
(74) *Attorney, Agent, or Firm* — Onello & Mello, LLP

(57) ABSTRACT

A partition mount system includes an integrated plunger assembly. The integrated plunger assembly is constructed and arranged to be integrated into an interior of an end of an extension pole, for example a standard telescoping extension pole. Mounting of the plunger in an interior portion of the pole in this manner provides for a sleek design that is relatively lightweight. Assuming that the pole in which the anchor is mounted is part of a telescoping pole system, the anchor and plunger do not interfere with full travel of the interior pole with respect to other poles in the telescoping system. In this manner, operation of the telescoping pole system is not inhibited by the integrated plunger assembly.

23 Claims, 17 Drawing Sheets

Related U.S. Application Data continuation of application No. 12/683,650, filed on Jan. 7, 2010, now Pat. No. 8,066,051, which is a continuation of application No. 11/125,583, filed on May 10, 2005, now Pat. No. 7,658,219.

(60) Provisional application No. 60/598,782, filed on Aug. 3, 2004, provisional application No. 60/569,534, filed on May 10, 2004.

(51) Int. Cl.

| | |
|---|---|
| ***A47H 1/022*** | (2006.01) |
| ***A47H 13/00*** | (2006.01) |
| ***E04G 21/26*** | (2006.01) |

(56) References Cited

U.S. PATENT DOCUMENTS

| | | | |
|---|---|---|---|
| 1,705,625 | A | 3/1929 | Mitchell |
| 1,766,324 | A | 6/1930 | Berner |
| 2,219,169 | A | 10/1940 | Alter |
| 2,232,194 | A | 2/1941 | Zogby |
| 2,474,158 | A | 6/1949 | Neely |
| 2,487,585 | A | 11/1949 | Pencek |
| 2,816,769 | A | 12/1957 | Noble |
| 2,903,227 | A | 9/1959 | de Kalb Key |
| 2,942,829 | A | 6/1960 | Stiffel |
| 3,072,784 | A | 1/1963 | Mann |
| 3,090,826 | A | 5/1963 | Cochran |
| 3,118,363 | A | 1/1964 | Burgess, Jr. |
| 3,247,558 | A | 4/1966 | Kaufman |
| 3,322,381 | A | 5/1967 | Bubb |
| 3,327,310 | A | 6/1967 | Bethune et al. |
| 3,333,808 | A | 8/1967 | Du Boff |
| 3,350,120 | A | 10/1967 | Hinrichs |
| 3,433,510 | A | 3/1969 | Hulterstrum |
| 3,529,860 | A | 9/1970 | Jelley |
| 3,592,434 | A | 7/1971 | Murray |
| 3,604,397 | A | 9/1971 | Salerno |
| 3,608,991 | A | 9/1971 | Wade |
| 3,713,643 | A | 1/1973 | Gerstenberger |
| 3,767,253 | A | 10/1973 | Kluetsch |
| 3,792,510 | A | 2/1974 | Evett |
| 3,822,850 | A | 7/1974 | Elias |
| 3,858,988 | A | 1/1975 | Cohen |
| 3,861,663 | A | 1/1975 | Strickland |
| 3,863,554 | A | 2/1975 | Boyd |
| 3,952,877 | A | 4/1976 | Kindl |
| 3,956,784 | A | 5/1976 | Vargas |
| 3,972,272 | A | 8/1976 | Bagby |
| 3,994,463 | A | 11/1976 | Baker |
| 4,077,083 | A | 3/1978 | Siemund et al. |
| 4,078,756 | A | 3/1978 | Cross |
| 4,087,006 | A | 5/1978 | Schill |
| 4,111,217 | A | 9/1978 | Victor |
| 4,127,911 | A | 12/1978 | Cupp et al. |
| 4,139,101 | A | 2/1979 | Towfigh |
| 4,277,863 | A | 7/1981 | Faneuf |
| 4,379,654 | A | 4/1983 | Rovelli |
| 4,396,325 | A | 8/1983 | Joice-Cavanagh |
| 4,488,651 | A | 12/1984 | Bishop |
| 4,502,256 | A | 3/1985 | Hahn |
| 4,536,924 | A | 8/1985 | Willoughby |
| 4,576,354 | A | 3/1986 | Blessing, Sr. |
| 4,586,844 | A | 5/1986 | Hammonds et al. |
| 4,592,797 | A | 6/1986 | Carlson |
| 4,645,473 | A | 2/1987 | Mochizuki |
| 4,662,034 | A | 5/1987 | Cunningham |
| 4,708,189 | A | 11/1987 | Ward |
| 4,715,089 | A | 12/1987 | Schema |
| 4,717,107 | A | 1/1988 | Servadio |
| 4,770,086 | A | 9/1988 | Gabster |
| 4,794,974 | A | 1/1989 | Melino |
| 4,824,302 | A | 4/1989 | Schultheis et al. |
| 4,852,844 | A | 8/1989 | Villaveces |
| 4,874,028 | A | 10/1989 | Lynch et al. |
| 4,885,876 | A | 12/1989 | Henke |
| 4,907,835 | A | 3/1990 | Salters |
| 4,912,814 | A | 4/1990 | McKenzie |
| 4,926,522 | A | 5/1990 | Wang |
| 4,928,916 | A | 5/1990 | Molloy |
| 4,949,523 | A | 8/1990 | Kassem |
| 4,969,241 | A | 11/1990 | Griffin |
| 5,038,889 | A | 8/1991 | Jankowski |
| 5,040,915 | A | 8/1991 | Stuart et al. |
| 5,056,753 | A | 10/1991 | Lanau et al. |
| 5,078,348 | A | 1/1992 | Babitchenko |
| 5,116,012 | A | 5/1992 | Offenhauer et al. |
| 5,129,774 | A | 7/1992 | Balseiro et al. |
| 5,131,781 | A | 7/1992 | Klein |
| 5,170,974 | A | 12/1992 | Ruggiero |
| 5,240,058 | A | 8/1993 | Ward |
| 5,287,614 | A | 2/1994 | Ehrlich |
| 5,299,773 | A | 4/1994 | Bertrand |
| 5,301,915 | A | 4/1994 | Bahniuk et al. |
| 5,308,280 | A | 5/1994 | Dotson |
| 5,331,706 | A | 7/1994 | Graham |
| 5,345,989 | A | 9/1994 | Brophy |
| 5,375,303 | A | 12/1994 | Shenier |
| 5,379,491 | A | 1/1995 | Solo |
| 5,384,938 | A | 1/1995 | Frederick |
| 5,388,283 | A | 2/1995 | Garnett |
| 5,400,959 | A | 3/1995 | Cone |
| 5,404,602 | A | 4/1995 | Kondo |
| 5,469,607 | A | 11/1995 | Henningsson et al. |
| 5,497,537 | A | 3/1996 | Robinson et al. |
| 5,524,693 | A | 6/1996 | Hamilton |
| 5,529,326 | A | 6/1996 | Hwang |
| 5,536,229 | A | 7/1996 | Albergo |
| 5,542,209 | A | 8/1996 | Sheu |
| 5,555,607 | A | 9/1996 | Parveris |
| 5,558,501 | A | 9/1996 | Wang et al. |
| 5,584,456 | A | 12/1996 | Stephens |
| 5,640,826 | A | 6/1997 | Hurilla |
| 5,645,272 | A | 7/1997 | Brennan, Sr. |
| 5,647,607 | A | 7/1997 | Bolieau |
| 5,649,780 | A | 7/1997 | Schall |
| 5,666,702 | A | 9/1997 | Ming-Chieh |
| 5,673,741 | A | 10/1997 | Cairns |
| 5,685,112 | A | 11/1997 | Fara |
| 5,707,032 | A | 1/1998 | Ehrlich |
| 5,715,620 | A | 2/1998 | Walker |
| 5,722,691 | A | 3/1998 | Patel |
| 5,803,653 | A | 9/1998 | Zuffetti |
| 5,832,652 | A | 11/1998 | Bartys |
| 5,884,424 | A | 3/1999 | Smith |
| 5,897,085 | A | 4/1999 | Cronin |
| 5,918,843 | A | 7/1999 | Stammers |
| 5,924,469 | A | 7/1999 | Whittemore |
| 5,937,488 | A | 8/1999 | Geiger |
| 5,940,942 | A | 8/1999 | Fong |
| 5,941,434 | A | 8/1999 | Green |
| 5,941,586 | A | 8/1999 | Fann |
| 5,944,464 | A | 8/1999 | Cole, Jr. |
| 5,979,110 | A | 11/1999 | Tai |
| 6,053,527 | A | 4/2000 | Gans et al. |
| 6,067,691 | A | 5/2000 | Feltman |
| 6,082,945 | A | 7/2000 | Jeffries et al. |
| 6,152,434 | A | 11/2000 | Gluck |
| 6,164,605 | A | 12/2000 | Drake et al. |
| 6,170,112 | B1 | 1/2001 | Mayfield et al. |
| 6,209,615 | B1 | 4/2001 | Whittemore |
| 6,237,182 | B1 | 5/2001 | Cassar |
| 6,321,823 | B1 | 11/2001 | Whittemore |
| 6,341,401 | B1 | 1/2002 | Lin |
| 6,378,175 | B1 | 4/2002 | Vanderpan |
| 6,467,741 | B1 | 10/2002 | Shih |
| 6,474,609 | B1 | 11/2002 | Pinard |
| 6,490,749 | B1 | 12/2002 | Morad |
| 6,508,295 | B2 | 1/2003 | Whittemore |
| 6,523,231 | B1 | 2/2003 | Lassiter |
| 6,729,358 | B1 | 5/2004 | Moffatt |
| 6,908,250 | B2 | 6/2005 | Moffatt |
| 6,942,004 | B2 | 9/2005 | Whittemore |

(56) References Cited

U.S. PATENT DOCUMENTS

| | | | | |
|---|---|---|---|---|
| 6,953,076 | B2 | 10/2005 | Whittemore | |
| 7,108,040 | B2 | 9/2006 | Whittemore | |
| 7,261,140 | B2 | 8/2007 | Whittemore | |
| 7,503,373 | B2 | 3/2009 | Whittemore | |
| 7,533,712 | B2 | 5/2009 | Whittemore et al. | |
| 7,658,219 | B2 | 2/2010 | Whittemore | |
| 8,066,051 | B2 | 11/2011 | Whittemore | |
| 8,371,360 | B2 | 2/2013 | Whittemore | |
| 8,857,499 | B2 * | 10/2014 | Whittemore | E04G 21/24 160/351 |
| 2001/0029640 | A1 | 10/2001 | Cassar | |
| 2002/0011316 | A1 | 1/2002 | Whittemore | |
| 2003/0028988 | A1 | 2/2003 | Streutker et al. | |
| 2003/0070773 | A1 | 4/2003 | Whittemore | |
| 2003/0154588 | A1 | 8/2003 | Blacket et al. | |
| 2004/0065799 | A1 | 4/2004 | Whittemore et al. | |
| 2004/0200585 | A1 | 10/2004 | Whittemore | |
| 2005/0247414 | A1 | 11/2005 | Whittemore | |
| 2005/0284591 | A1 | 12/2005 | Whittemore | |
| 2006/0272785 | A1 | 12/2006 | Whittemore | |
| 2008/0006374 | A1 | 1/2008 | Whittemore | |
| 2009/0071614 | A1 | 3/2009 | Whittemore | |
| 2010/0108849 | A1 | 5/2010 | Whittemore | |
| 2012/0049034 | A1 | 3/2012 | Whittemore | |

FOREIGN PATENT DOCUMENTS

| | | |
|---|---|---|
| DE | 29605222 | 7/1996 |
| EP | 0976351 | 2/2000 |
| FR | 2411282 | 6/1979 |
| GB | 1042086 | 9/1966 |
| GB | 2156894 | 10/1985 |
| GB | 2325397 | 11/1998 |
| JP | 2001503487 | 3/2001 |
| JP | 2003206640 | 7/2003 |
| WO | 8603538 | 6/1986 |
| WO | 9109556 | 7/1991 |
| WO | 94/27480 | 12/1994 |

OTHER PUBLICATIONS

North American Marketing Representatives, Inc. "Power Pole". http:/www.waldmannbenches.com/power5205pole520content.htm (Nov. 2004).

"Snapwall Temporary Wall Support", brochure by C&S Manufacturing Inc.

"KwikPole", Brochure by KwikPole, Inc. www.kwikpole.com/setup.html (Aug. 2003).

"Partition Mount With Integrated Plunger Assembly" Specification, Drawings, and Prosecution History of U.S. Pat. No. 7,658,219, issued on Feb. 9, 2010, by Jeffrey P. Whittemore, which is stored in the United States Patent and Trademark Office (USPTO) system.

Office Action dated Nov. 9, 2011, issued in related Japanese application No. 2007513276.

"Partition Mount With Integrated Plunger Assembly" Specification, Drawings, and Prosecution History of U.S. Pat. No. 8,066,051, issued on Nov. 29, 2011, by Jeffrey P. Whittemore, which is stored in the United States Patent and Trademark Office (USPTO) system.

"Partition Mount With Integrated Plunger Assembly" Specification, Drawings, and Prosecution History of U.S. Appl. No. 13/288,394, filed Nov. 3, 2011, by Jeffrey P. Whittemore, which is stored in the United States Patent and Trademark Office (USPTO) system.

"Partition Mount With Integrated Plunger Assembly" Specification, Drawings, and Prosecution History of U.S. Appl. No. 13/746,845, filed Jan. 22, 2013, by Jeffrey P. Whittemore, which is stored in the United States Patent and Trademark Office (USPTO) system.

Extended European Search Report dated Apr. 15, 2014 in corresponding European application No. 13170901.6.

Opposition Notice dated Dec. 2, 2014 in related EP Application No. 05746974.4.

Opposition Notice dated Feb. 1, 2016 in related EP Application No. 05746974.4.

Office Action dated Mar. 2, 2016, issued in related European Application No. 13170901.6.

Response to Opposition Notice dated Jul. 24, 2015 in related EP Application No. 05746974.4.

* cited by examiner

PARTITION MOUNT WITH INTEGRATED PLUNGER ASSEMBLY

RELATED APPLICATIONS

This application is a continuation application of U.S. application Ser. No. 13/746,845, filed on Jan. 22, 2013, which is a continuation of U.S. application Ser. No. 13/288,394, filed on Nov. 3, 2011, now U.S. Pat. No. 8,371,360, issued on Feb. 12, 2013, which is a continuation application of U.S. application Ser. No. 12/683,650, filed on Jan. 7, 2010, now U.S. Pat. No. 8,066,051, which is a continuation application of U.S. application Ser. No. 11/125,583, filed May 10, 2005, now U.S. Pat. No. 7,658,219, which claims the benefit of U.S. Provisional Application Ser. No. 60/569,534, filed May 10, 2004, and U.S. Provisional Application Ser. No. 60/598,782, filed Aug. 3, 2004, the contents of each being incorporated herein by reference, in their entirety.

BACKGROUND OF THE INVENTION

Partition systems are employed to isolate portions of a building or room, by serving as a barrier to dust, noise, light, odors, and the like. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple a curtain or partition material to the floor, ceiling, and abutting walls, resulting in damage to their surfaces. Others tape, or otherwise adhere, a curtain or plastic sheet to the walls and ceilings. The tape usually fails to stick, but if it does stick, as the tape is removed, paint can pull off with the tape, or adhesive is left behind.

U.S. Pat. No. 5,924,469, the content of which is incorporated herein by reference, discloses a partition mount system that addresses these limitations. This system offers the advantage of accommodating standard extension poles, for example, painter's poles, or telescoping painter's poles, with standard threads, and is compatible with a variety of commercially-available curtain or drape materials, for example plastic and cloth sheeting, and the like. The disclosed system is a "clean" system designed to be installed and removed without damaging or otherwise marking the ceiling, floor or walls in the construction zone. Assembly is easy and fast and can be accomplished by a single individual.

In one embodiment of the disclosure of U.S. Pat. No. 5,924,469, a plastic mount, or jack, includes a spring-loaded plunger to which a mounting head is attached. The jack is mounted to a top end of a standard painter's pole at a threaded interface. While this system is durable, easy-to-use, and reliable, the jack could be considered by some to be top-heavy at times, especially when mounted to a relatively long pole. In addition, the jack could be considered by some to be relatively bulky during shipping and distribution.

SUMMARY OF THE INVENTION

The present invention is directed to a partition mount system having an integrated plunger assembly. The integrated plunger assembly is constructed and arranged to be integrated into an interior of an end of an extension pole, for example a standard telescoping extension pole.

In this manner, by integrating the plunger within the pole, the present invention provides a system that is less top-heavy and therefore easier to use and install. Fewer components are needed, and a sleeker, light-weight, design is achieved, improving packaging and shipping efficiency. Assuming that the pole in which the anchor is mounted is part of a telescoping pole system, the anchor and plunger do not interfere with full travel of the interior pole with respect to other poles in the telescoping system. In this manner, operation of the telescoping pole system is not inhibited by the integrated plunger assembly.

In one embodiment, the mounting assembly includes an anchor, a spring, a retainer wire, and a plunger. The anchor is cylindrical and mounted within an upper portion of the extension pole. The anchor is fixed within the pole, for example by dimpling the body of the pole to the anchor. The plunger is mounted above the anchor within the pole, and a first end of the retainer wire is fixed to a first end of the plunger. The second end of the retainer wire slides with respect to the anchor and is captured by the anchor to prevent its release. The spring is compressed between the anchor and the plunger so that the plunger is biased in an outward direction with respect to the top end of the pole.

In one embodiment, a mounting head is connected to a distal end of the plunger at a universal joint. The head is adapted for mating with a corresponding clip for securing a curtain to the plunger assembly. Compression of the spring operating on the plunger urges the head and clip against the ceiling. A retaining device, for example a tether in the form of a rope, chain, fastener, wire, cord, strap or plastic attachment, is used to connect the clip to the head. In one embodiment, the retaining device is detachable from the head, the clip, or both, so as not to limit positioning of the curtain between the head and the clip, such as in the case where a central portion of the curtain is to be supported by the plunger assembly. The retaining device can be fixed to the head and clip by fasteners, for example by hooks, clamps, clips or clasps. In one embodiment, the head and/or clip includes a keyed tether slot and the tether includes a key or extension that mates with the tether slot, such that the retaining device can be removably secured to the clip and/or head.

In one aspect, the present invention is directed to a partition mount. The partition mount includes an elongated adjustable-length pole having a foot end and a head end, the pole having a longitudinal axis. An anchor is secured within the pole at a position proximal to the head end. A mounting head extends from the head end of the pole and travels in a direction along the longitudinal axis of the pole relative to the anchor position. The mounting head includes a mounting unit that removably secures a sheet of material. A compression mechanism biases the position of the head in an outward direction away from the anchor.

In one embodiment, the partition mount further comprises a retainer that prevents the mounting head from being released from the pole by controlling a travel distance of the mounting head. In another embodiment, the retainer comprises an elongated wire. In another embodiment, the anchor and retainer permit travel of the mounting head between a first position at which the compression mechanism is under a first compression and a second position at which the mounting head is at least partially in the pole and at which the compression mechanism is under a compression amount less than the first compression.

In another embodiment, the pole comprises an extension pole having multiple telescoping segments, and the head end of the pole is at an inner segment of the extension pole. In another embodiment, the extension pole further comprises a locking mechanism that secures the positioning of adjacent pole segments relative to each other. In another embodiment, the anchor is secured within the pole so as not to inhibit sliding action of the inner segment of the pole relative to other segments of the pole.

In another embodiment, the mounting unit comprises first and second portions that secure a sheet of material therebetween. In another embodiment, the first and second portions of the mounting head extend in a direction that is transverse to the longitudinal axis of the pole. In another embodiment, the first portion includes at least one pin and the second portion includes at least one aperture that receives the at least one pin. In another embodiment, the at least one pin and the at least one aperture mate in a snap-fit relationship to secure the first and second portions together. In another embodiment, the at least one aperture comprises a keyhole and slot, and the mating at least one pin comprises a retaining knob, and the first portion and second portion are secured by inserting each pin in a mating keyhole and sliding the pin from the keyhole and into the slot where the pin is retained in the aperture by the retaining knob. In another embodiment, the first portion comprises a head and the second portion comprises a clip that is removably coupled to the head.

In another embodiment, the first portion includes a plurality of legs that extend about at least one side surface of the second portion. In another embodiment, the legs further extend about a second surface of the second portion, the second surface being opposite a first surface of the second portion at which the second portion interfaces the first portion and an inserted sheet of material. In another embodiment, the first portion comprises a head and the second portion comprises a clip that is removably coupled to the head.

In another embodiment, the partition mount further comprises a tether for coupling the first and second portions. In another embodiment, the tether is releasable from at least one of the first and second portions. In another embodiment, the tether comprises an elongated strap and at least one end of the tether comprises a key, and a corresponding one of the first and second portions comprises a slot for removably receiving the tether key.

In another embodiment, a high-friction material is applied to an upper surface of the second portion. In another embodiment, a high-friction material is applied to at least one of the first portion and the second portion of the mounting unit at a position where the first portion and the second portion interface In another embodiment, the compression mechanism comprises a spring.

In another embodiment, the mounting head comprises a neck and the mounting unit and a pivot joint is provided between the neck and the mounting unit to permit pivot of the mounting unit relative to the pole.

In another embodiment, the anchor is secured within the pole by dimpling the pole body into the anchor.

In another embodiment, the partition mount further comprises a dampener for dampening force imparted on the anchor by rapid release of the mounting head under bias by the compression mechanism.

In another aspect, the present invention is directed to a partition mount. An elongated adjustable-length extension pole includes multiple telescoping segments, the pole having a foot end and a head end, the head end of the pole being at an inner segment of the pole, and the pole having a longitudinal axis. An anchor is secured within the pole at a position proximal to the head end. A mounting head extends from the head end of the pole, and travels in a direction along the longitudinal axis of the pole relative to the anchor position. The mounting head includes a neck that extends into the head end of the pole and a mounting unit that removably secures a sheet of material, the neck and mounting unit being coupled by a pivot joint that permits pivot of the mounting unit relative to the pole. A compression mechanism comprising a spring biases the position of the head in an outward direction away from the anchor. A retainer prevents the mounting head from being released from the head end of the pole by controlling a travel distance of the mounting head.

In another aspect, the present invention is directed to a partition mount. An elongated adjustable-length pole has a foot end, a head end, and a longitudinal axis. A mounting head is provided at the head end of the pole and travels in a direction along the longitudinal axis of the pole. The mounting head includes a mounting unit including a first portion and a second portion that removably secure a sheet of material therebetween. A compression mechanism biases the position of the head in an outward direction relative to the pole. A tether couples the first and second portions, at least one of a first end and a second end of the tether being removably secured to the corresponding one of the first and second portions.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
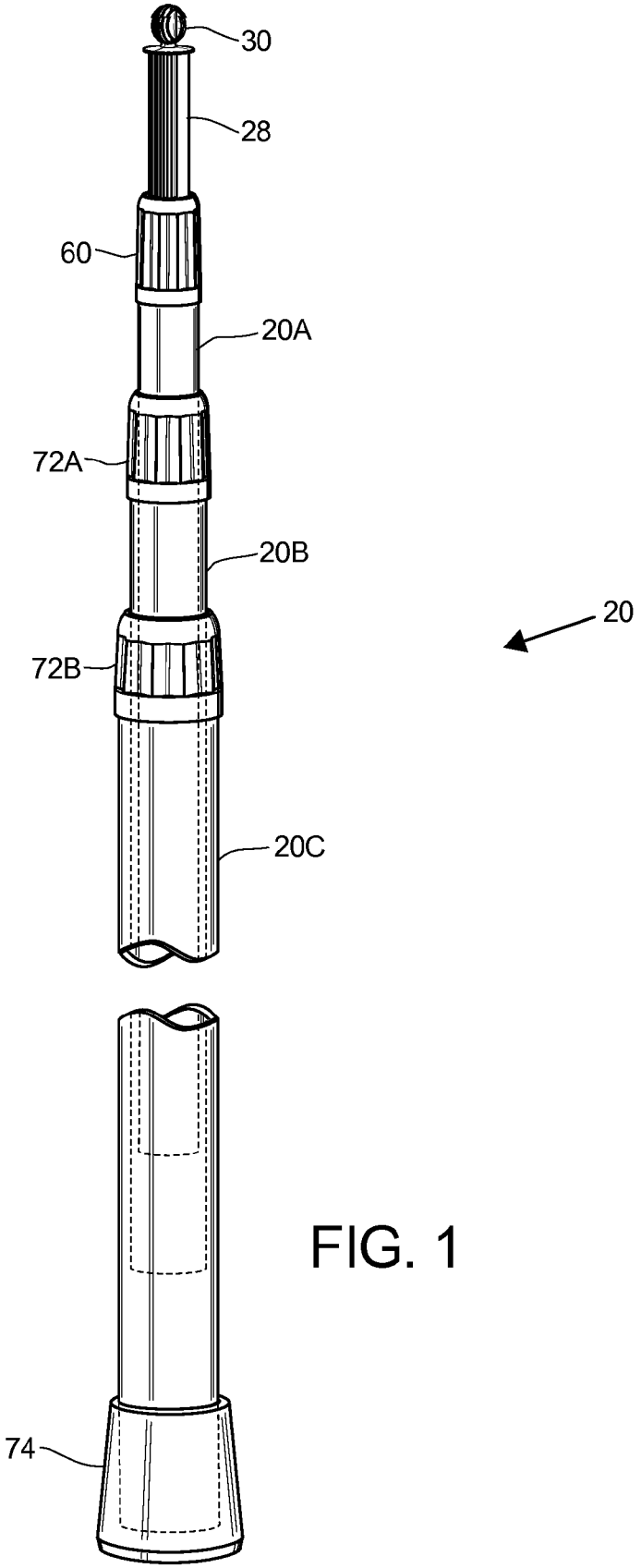
FIG. 1 is a side view of a curtain mounting system that incorporates an integrated plunger assembly in accordance with the present invention.

FIG. 1 is a side view of a telescoping extension pole curtain mounting system including an integrated plunger assembly in accordance with the present invention. The pole 20 includes an inner pole 20A, an intermediate pole 20B, and an outer pole 20C that extend with respect to each other in telescopic fashion. The relative extensions of the inner, intermediate, and outer poles 20A, 20B, 20C are typically set by rotating the poles with respect to each other, and, as a result of the rotation, an interior locking mechanism fixes their respective lengths. External collars 72A, 72B prevent pinching of fingers or other objects between the respective poles and optionally can provide an external locking mechanism for locking the respective longitudinal positions of the poles. A foot 74 formed of high-friction material such as rubber, at the bottom of the outer pole 20C, prevents the pole from slipping in a lateral direction when mounted on a surface, such as a floor.

A plunger 28, for example including a universal joint ball 30, includes a longitudinally extending body that extends from a top end of the inner pole 20A and is retained by an anchor. The plunger 28 is outwardly biasable. Biasing of the plunger 28 can be performed, for example, by a spring that resides in an interior portion of the inner pole 20A. When the plunger 28 is pressed in a longitudinal direction into the inner pole, the spring operates to bias the plunger 28 in an opposite, outward direction. In this manner, the pole 20 and integrated plunger 28, when compressed and mounted between two surfaces, for example between a floor and a ceiling of a room, are outwardly biased toward the floor and ceiling, which secures the curtain mounting system, and associated curtain material, in place.

In one embodiment, a retaining wire (see, for example, wire 26 below in FIG. 3B) and anchor (see, for example, anchor 22 below in FIG. 3B) operate to prevent the plunger 28 from being released from the upper end of the inner pole 20A. An optional collar 60 is placed over the distal end of the inner pole 20A and includes an aperture for allowing the plunger 28 to glide freely therethrough. The collar 60 and plunger body 28 are optionally keyed to allow for their relative longitudinal movement, while restricting rotational movement, to prevent the plunger 28 and mounting head mounted thereto from rotating relative to the pole 20.

Figure 2:
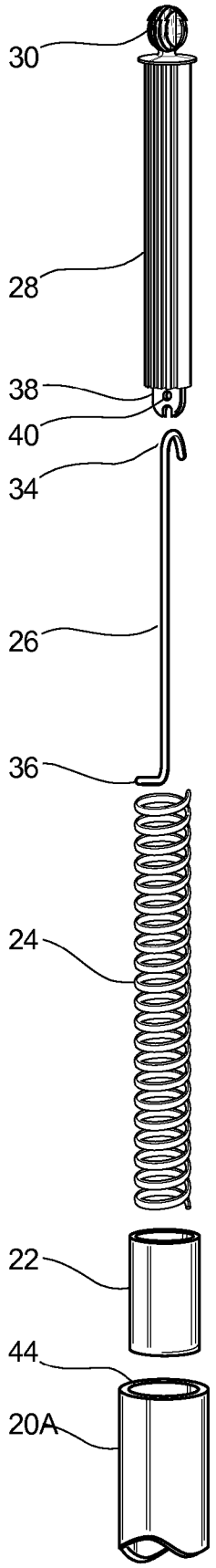
FIG. 2 is an exploded side view of the integrated plunger assembly of FIG. 1.

FIG. 2 is an exploded side view of the integrated plunger assembly. The plunger assembly includes an anchor 22, a spring 24, a retainer wire 26, and a plunger 28. The anchor 22 is generally cylindrical in shape and is formed of a pliable, or malleable yet resilient, material. The anchor 22 mounts within the inner pole 20A such that its position is fixed within the pole 20A. In one example, the anchor 22 is placed at an appropriate position within the inner pole 20A, and near an upper end 44 of the inner pole 20A, and the outer surface of the pole 20A is dimpled 56 (see FIG. 3A) for example using a punch tool, such that the anchor 22 is pinched between the dimples 56 and thereby secured in place within the pole 20A.

The retainer wire 26 slides freely through the anchor 22 and includes an elbow 36 at a first end to prevent its full release from the anchor 22. A second end of the retainer wire includes a hook 34 that mates with a corresponding hole 40 formed in a flange 38 of the plunger 28. The spring 24 is seated between the anchor 22 and the plunger 28 about the retainer wire 26. In one embodiment, the retainer wire 26 is shorter in length than the spring 24. In this manner, the spring 24, supported at a first end by anchor 22, when under compression, exerts an outward biasing force on the plunger 28, while at the same time, the retainer wire 26 prevents release of the plunger 28 from the inner pole 20A.

Figure 3A:
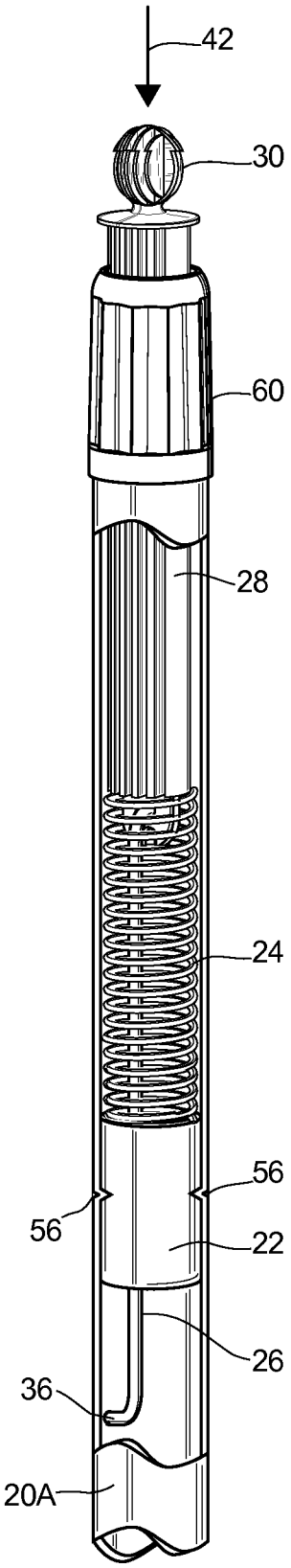
FIG. 3A is a sectional assembled side view of the integrated plunger assembly with the plunger under compression, in accordance with the present invention.
Figure 3B:
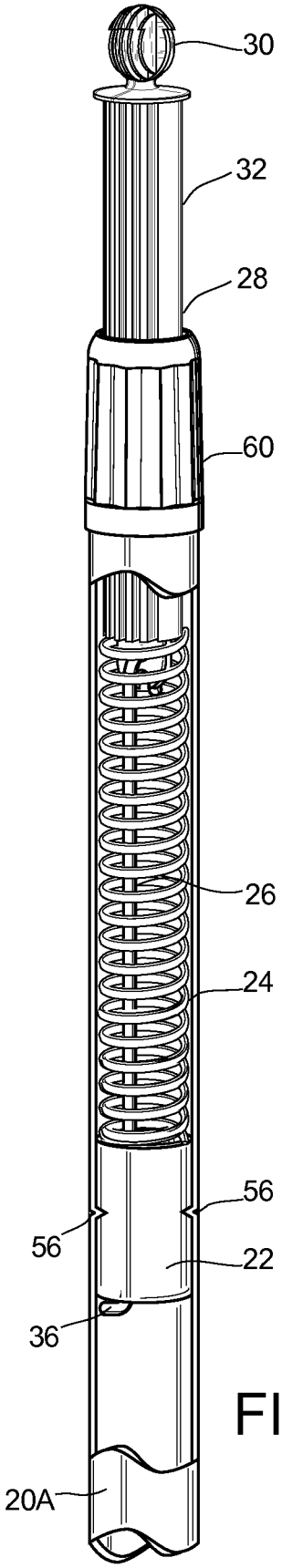
FIG. 3B is a sectional assembled side view of the integrated plunger assembly with the plunger fully extended, in accordance with the present invention.

With reference to FIG. 3A, when an inwardly directed force 42 is exerted on the plunger 28, the plunger 28 is urged in a direction toward the anchor 22 within the inner pole 20A and the spring 24 is compressed between spring seats on the bodies of the anchor 22 and the plunger 28. The retainer wire 26 slides freely through the anchor 22 to allow for travel of the plunger 28 within the pole 20A. Turning now to FIG. 3B, when the inward force 42 is released, the compression of the spring 24 operates to exert an outwardly directed force on the plunger 28, extending the body 32 of the plunger 28 in a direction outward of the inner pole 20A. The elbow 36 in the first end of the retainer wire 26 prevents the plunger 28, retainer wire 26, and spring 24, from being released from the end of the inner pole 20A, thus limiting the outward travel of the plunger 28.

In the embodiments shown, the anchor 22 is retained and secured in place by dimpling the body of the inner pole 20A into the anchor 22 at dimples 56. Alternatively, the anchor 22 may be mechanically riveted, chemically bonded, or otherwise mounted in place within the interior of the pole 28. Preferably, the mechanism used to secure the anchor within an interior portion of the inner pole 20A does not interfere with the extension and compression of the inner pole 20A relative to the intermediate pole 20B or outer pole 20C.

In one embodiment, the anchor 22 position relative to the upper end 44 (refer to FIG. 2) of the inner pole 20A, as well as the length of the retainer wire 26, are selected such that when the plunger 28 is in a fully extended position relative to the anchor 22, the hook 34 of the retainer wire projects just beyond the upper end 44 of the inner pole so that the interface of the hook 34 and the hole 40 of the plunger 28 can be accessed only by first removing the collar 60. In this manner, inadvertent removal of the plunger 28 is prevented, while permitting service access should the need for component replacement arise.

Figure 4:
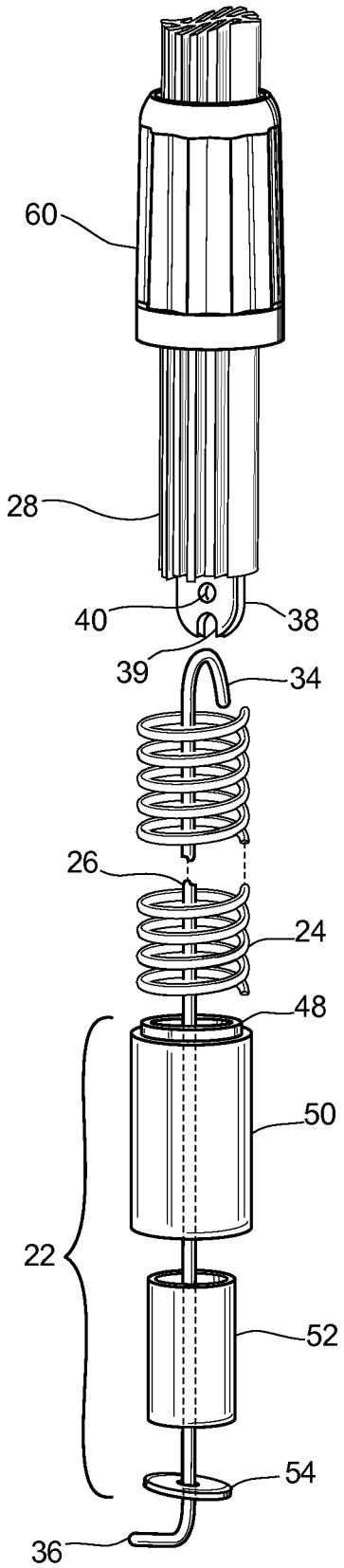
FIG. 4 is an exploded close-up perspective view of the components of the integrated plunger assembly, in accordance with the present invention.

FIG. 4 is a close up view of the components of the integrated plunger assembly, in accordance with the present invention. The plunger 28 is formed of a lightweight, strong and durable material, for example of a molded Lexan™, or polycarbonate, material. The anchor 22, includes a cylindrical anchor body 50, a cylindrical dampener 52, and a washer 54. The anchor body 50 includes a neck 48 that provides a seat surface for an end of the spring 24. The anchor body 50 is formed, for example, of a molded ABS™ material. The outer diameter of the anchor body 50 is preferably slightly less than the inner diameter of the pole 20 in which it is to be mounted. The cylindrical dampener 52 is seated within the anchor body 50 and rests against an inner wall at the neck end of the inner body 50. The dampener 52 is formed of a shock-absorbent material, such as polyurethane, and is tubular in shape so as to provide for an appropriate degree of longitudinal compression. The washer 54 snaps into a seat at a tail end of the anchor body 50 and secures the dampener 52 in place within the body 50.

Returning to FIG. 3B, when inward force operating on the plunger 28 is released, an outward force is imparted on the plunger 28 by spring 24 until the elbow 36 of the retainer wire 26 abuts the washer 54 of the anchor 22. When this occurs, the anchor 22 is subject to a large amount of shock due to the impact of the acceleration of the spring operating on the elbow 36 of the retainer wire 26 that impacts the anchor 22. Returning to FIG. 4, the dampener 52 of the anchor 22 operates to absorb the shock of the impact, which prevents excessive wear on the system components and lengthens component lifetime.

The plunger 28 includes a flange 38 that extends from a base of the plunger. The flange 38 includes a notch 39 and a hole 40. When the hook 34 of the retainer wire 26 is applied at a predetermined angle with respect to the flange 38, the end of the hook 34 can be mated with hole 40, while the body of the retainer wire 26 in the vicinity of the hook 34 rests within the notch 39 to allow the end of the hook 34 to reach the hole 40. Upon mating the hook 34 and the hole 40, the spring 24 can be seated about the flange 38. The spring is preferably of an inner diameter that is greater than the width of the flange 38, and is of an outer diameter that is less than the diameter of the plunger body 32, so that the flange 38 provides a suitable seat for the spring 24. Once mounted, spring 24 exerts an outward force between the anchor 22 and the plunger 28, while at the same time, the retainer wire 26 prevents the plunger 28 from being released from the anchor 22. The spring 24 is thus compressed between the plunger 28 and anchor 22, and the plunger 28 is thereby biasable in an outward direction relative to the pole 20.

Figure 5A:
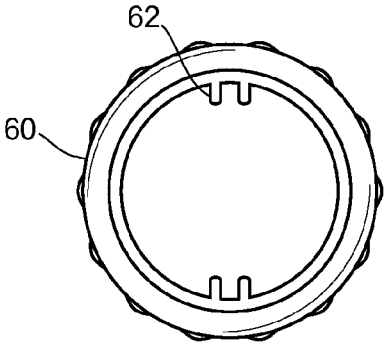
FIGS. 5A and 5B are top and perspective side views respectively, of a collar of the integrated plunger assembly, in accordance with the present invention.
Figure 5B:
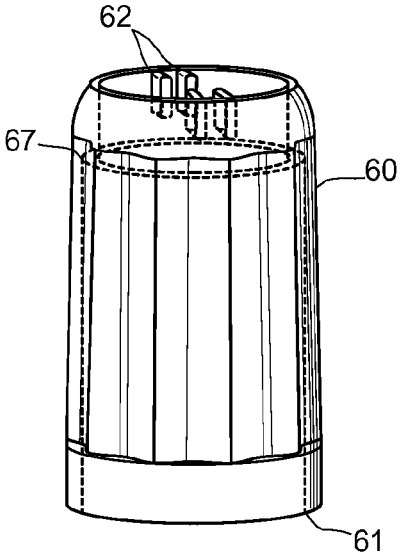

FIGS. 5A and 5B are top and side views respectively of collar 60. The collar 60 includes an inner seat 61 that is press-fit onto the end of the inner pole 20A. A stop 67 prevents the pole end 44 from sliding through the entire collar 60. The collar 60 further includes inner guides 62 that mate with races 72 (see FIGS. 6A and 6B) that extend in a longitudinal direction along the body of the plunger 28. The mating guides 62 of the collar 60 and races 72 of the plunger 28 prevent rotation of the plunger 28 relative to the pole 20 to which the plunger is mounted.

Figure 6A:
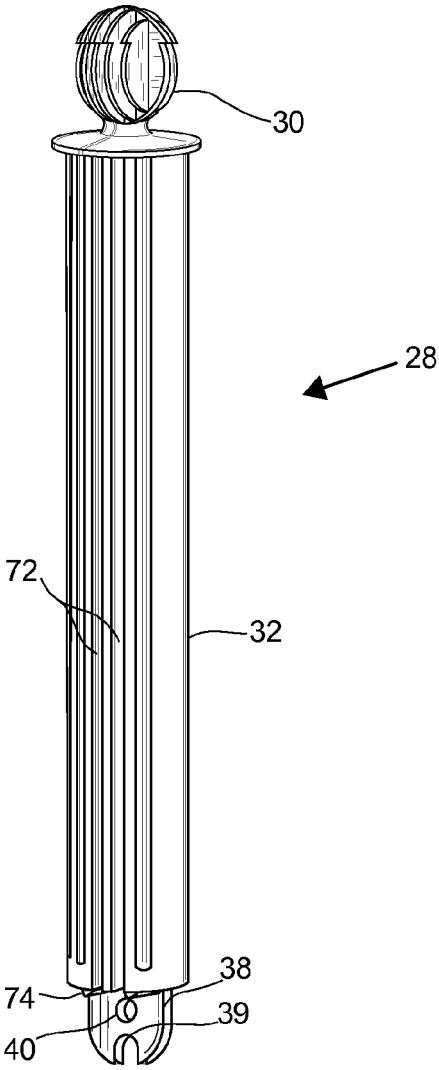
FIGS. 6A and 6B are perspective side and bottom views respectively, of the plunger of the integrated plunger assembly, in accordance with the present invention.
Figure 6B:
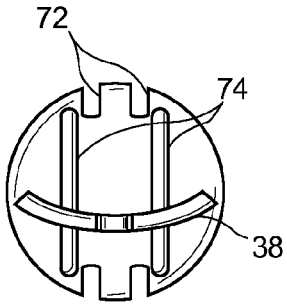

FIGS. 6A and 6B are side and bottom views respectively of the plunger 28. The plunger 28 includes a longitudinally extended body 32 having a universal joint ball 30 at a first end and a flange 38 at a second end. Races 72 are formed along the plunger body 32 for mating with the guides 62 in the collar 60 as described above. The interaction of the races 72 and guides 62 prevents rotation of the plunger 28 relative to the pole 20 to which the plunger 28 is mounted. The body of the flange 38 has a curved profile, to allow the retainer wire 26 to align with a central axis of the plunger body 32 when mounted to allow for smooth travel. Raised features 74 formed in an underside of the plunger body 32 provide a seat for the spring 24 and add strength to the flange 38.

The universal joint ball 30 is adapted to mate with a head for mounting a curtain, for example the heads described in U.S. Pat. No. 5,924,469; U.S. application patent Ser. No. 10/600,939, filed Jun. 20, 2003; and U.S. patent application Ser. No. 10/600,300, filed Jun. 20, 2003; the contents of each being incorporated herein by reference. Other interfaces, including threaded interfaces, press-fit interfaces, hinged interfaces, and integrated head interfaces, are equally applicable to the present invention. The invention is applicable to a variety of pole assemblies, and is not limited in application to telescoping assemblies. Also, while the above-described embodiment depicts a three-piece extension pole, the present invention is equally applicable to other types of extension poles, including two-piece extension poles. In addition, while the above-described embodiment depicts the anchor being mounted within an inner pole of the extension pole assembly, the anchor can optionally be mounted in the intermediate or outer extension pole of the extension pole assembly.

Figure 7A:
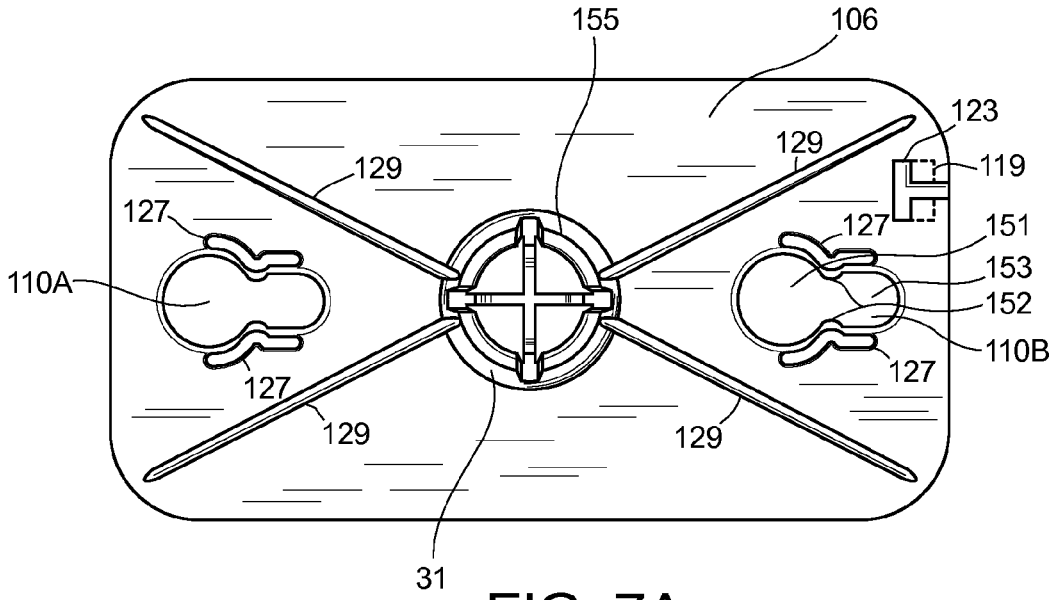
FIGS. 7A is a bottom view of a head of a coupling device and 7B is a bottom view of a clip of a coupling device, in accordance with the present invention.

FIGS. 7A is a bottom view of a head and 7B is a bottom perspective view of a clip of a coupling device adapted to interface with the universal joint ball 30 of the plunger 28, in accordance with the present invention. The head 106 includes a socket 31 that receives the ball 30 of the plunger 28 (see FIG. 6A). In combination, the socket 31 and the ball 30 form a universal joint. In one embodiment, the socket 31 includes elastically deformable teeth 155 that expand around the ball 30, when inserted, to provide a snap-fit relationship. In the embodiment illustrated, the head is generally in the shape of a flat plate, and includes apertures 110A and 110B. The apertures 110A, 110B are in the shape of a relatively large keyhole 151 that extends into a relatively narrow slot 153. Flex grooves 127 are formed through the body of the head 106 spaced apart a suitable distance from sidewalls 152 of the apertures 110A, 110B. The flex grooves 127 provide the aperture sidewalls 152 with a suitable degree of flexibility. The head 106 further includes ribs 129 that extend outward from the outer walls of the teeth 155 of the universal joint socket 31. The ribs 129 provide structural integrity to the universal joint socket 31 and head 106. The head 106 further includes keyed tether slot 123 the details and operation of which will be described below.

Figure 7B:
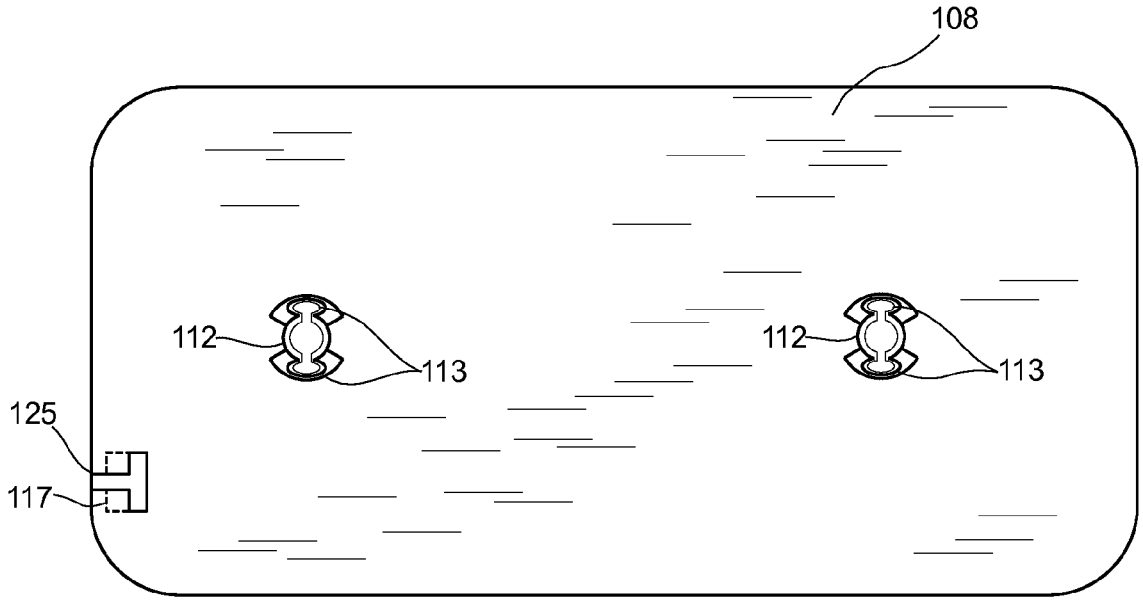

FIG. 7B is a bottom view of the clip 108 of the present invention. The clip 108, in this example, is generally in the shape of a flat plate, and includes two pins 112 that extend from its lower surface. The pins 112 include retaining knobs or lobes 113 at their distal ends. The clip 108, like the head 106, includes a keyed tether slot 125. In one embodiment, the pins 112, retaining knobs 113, and keyed tether slot 125 are configured such that the clip can be formed in a straight-pull molding process.

Figure 8A:
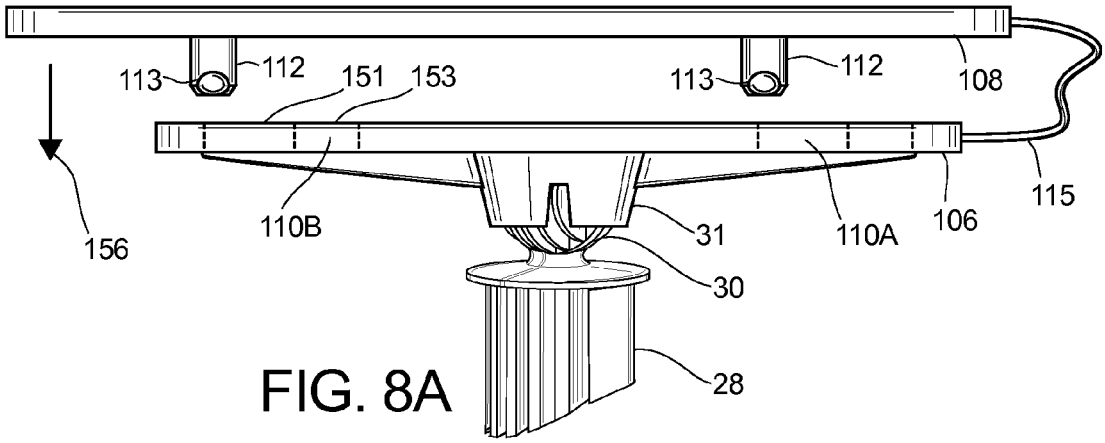
FIGS. 8A-8C are side views of the clip and head of FIGS. 7A and 7B sequentially illustrating the process of coupling the clip to the head and the integrated plunger assembly and FIG. 8D is a side view of an alternative embodiment of the clip and head assembly, in accordance with the present invention.
Figure 8B:
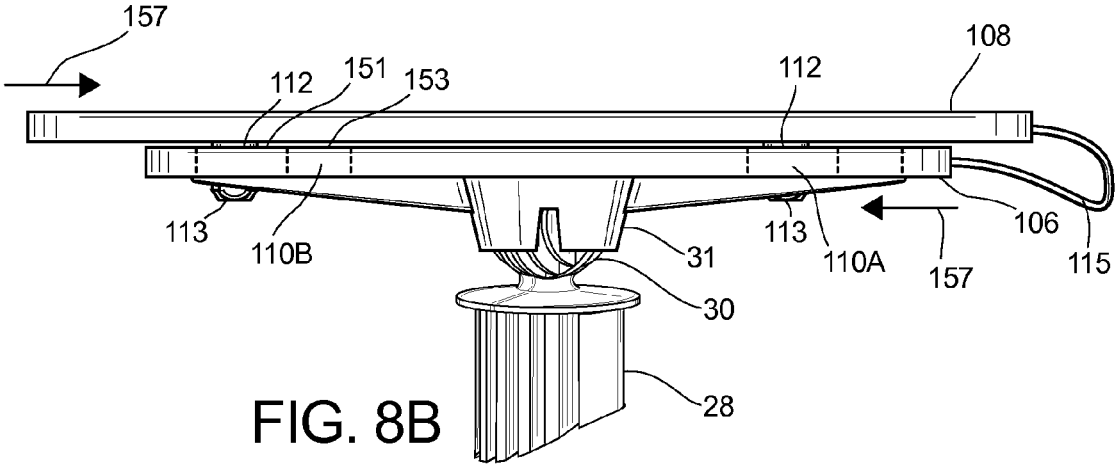
Figure 8C:
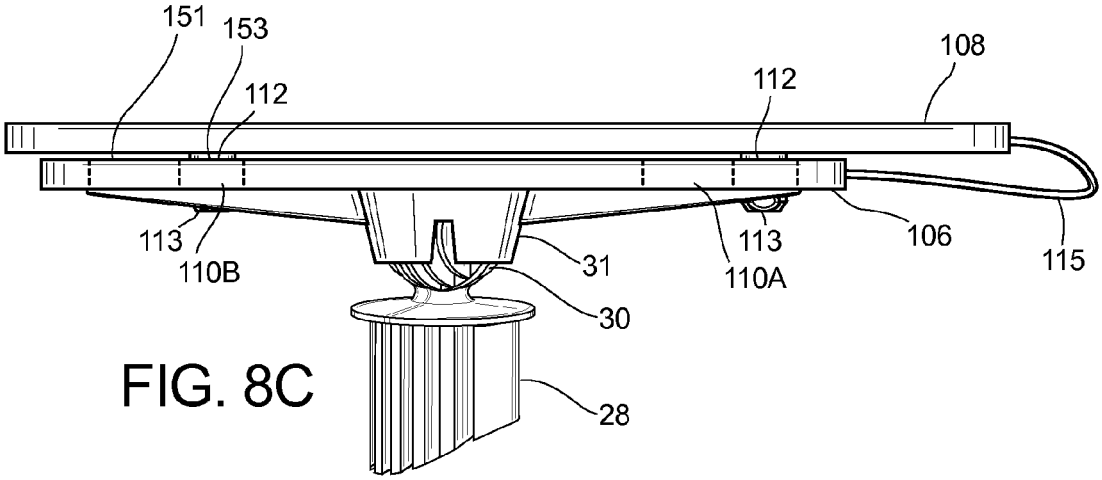
Figure 8D:
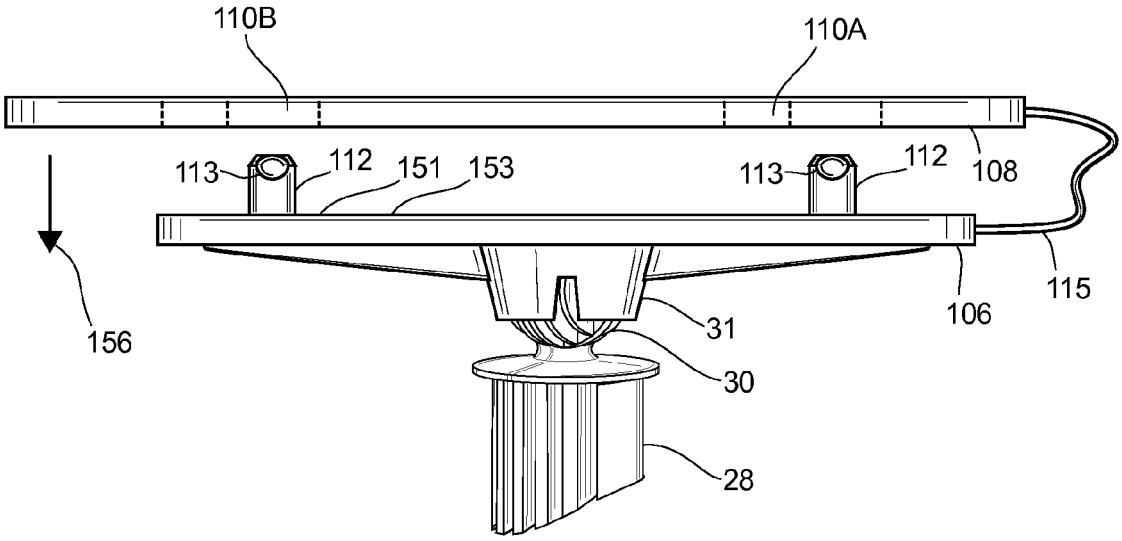

FIG. 8A-8C are side views of the clip and head of FIG. 7 sequentially illustrating the process of the clip 108 being coupled to the head 106, in accordance with the present invention. As shown in FIG. 8A, the universal joint ball 30 is inserted into the socket 31 of the head 106. In this manner, the head 106 can be rotated relative to the plunger 28 and pole 20 in three degrees of freedom. The apertures 110A, 110B of the head 106 are constructed and arranged to receive the pins 112 of the clip 108. In this example, two pins are provided, however, a mating clip and head with other numbers of pins and corresponding apertures are equally applicable to the present invention. In addition, in other embodiments, the pins 112 can be attached to the head 106, and the mating apertures 110A, 110B can be provided on the clip 108, as illustrated in FIG. 8D. Also, in other embodiments, the pins 112 on one of the clip and head can be constructed and arranged to snap into mating apertures on the other of the clip and head, in a snap-fit relationship.

The clip 108 is optionally connected to the head 106 by a tether 115, which, in some applications, is desired for preventing separation of a clip from a corresponding head. The tether 115 comprises for example a rope, fastener, wire, cord, chain, strap or plastic attachment. The tether 115 may be removable from either or both of the clip 108 and head 106. Alternatively, the tether 115 may be integral with either, or both, of the clip 108 and head 106.

In FIG. 8A, the pins 112 and retaining knobs 113 of the clip 108 are positioned over the large keyholes 151 of the apertures 110A, 110B of the head 106. A curtain to be installed (not shown) is placed between the clip 108 and head 106 at this time. The pins 112 and retaining knobs 113 are moved into position near keyholes 151 of the apertures 110A, 110B of the head 108, as shown by arrow 156. In FIG. 8B, the pins 112 and retaining knobs 113 of the clip 108 are inserted into the keyholes 151 of the apertures 110A, 110B of the head 106. At this time, the curtain material is primarily positioned between the lower surface of the clip 108 and the upper surface of the head 106, with the exception of the pin 112 and aperture 110A, 110B region, in which the curtain material extends about the body of the pins 112. The clip 108 and head 106 are then pushed relative to each other in a first direction, as shown by arrows 157, so that the body of the pins 112 engage the inner sidewalls 152 of the apertures 110A, 110B of the head 106. The flex grooves 127 cause the aperture sidewalls 152 to flex about the body of the pins 112, and the clip 108 is snapped into place when the pins 112 are seated in the relatively narrow slots 153 of the apertures 110A, 110B. In FIG. 8C, the pins 112 of the clip 108 are seated in the aperture slots 153, and the retaining knobs 113 abut the lower surface of the head 106, thereby securing the clip 108 to the head 106, with the curtain material (not shown) held in position therebetween.

In this embodiment, the head 106 and mating clip 108 extend in a direction that is transverse to the longitudinal axis of the extension pole 20 and plunger 28. The greater the extension of the head, the larger the area of interaction between the head/clip and curtain material, and therefore the stronger the interface. Also, a larger area of interaction prevents the curtain from tearing at the head from stress due to its own weight, or from an externally applied force.

Figure 9A:
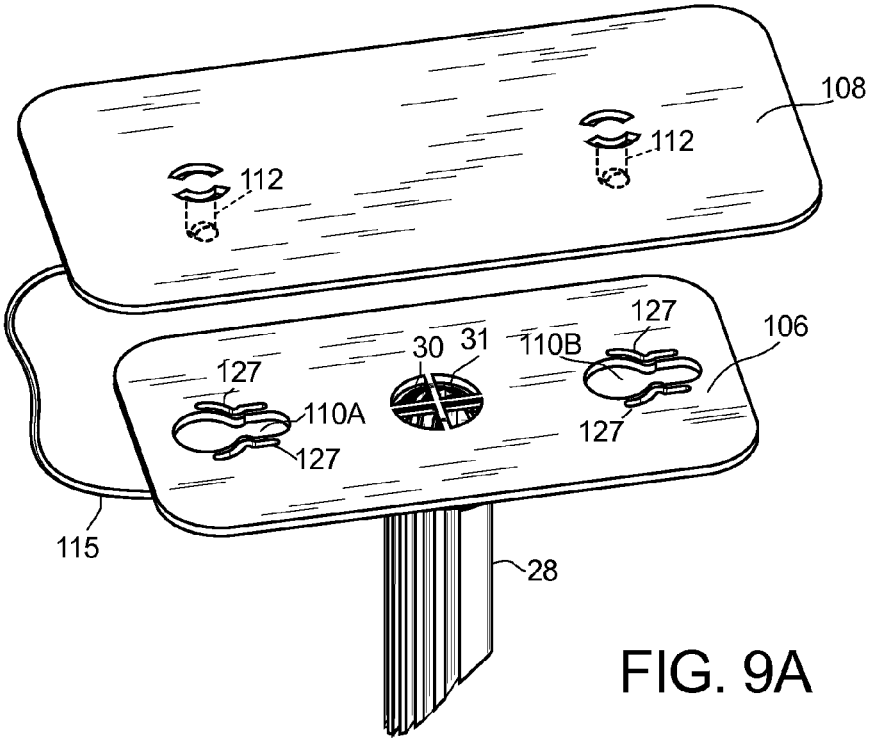
FIGS. 9A-9D are perspective views of the coupling device of FIGS. 7A and 7B, including a retaining device or tether for retaining the clip to the head when the clip is disengaged from the head, in accordance with the present invention.
Figure 9B:
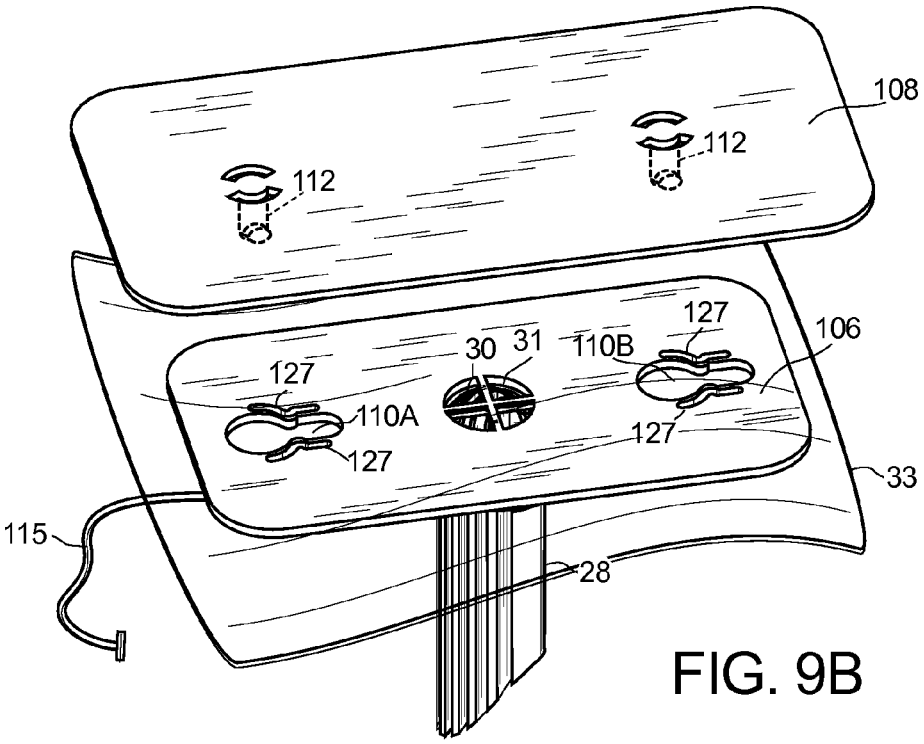
Figure 9C:
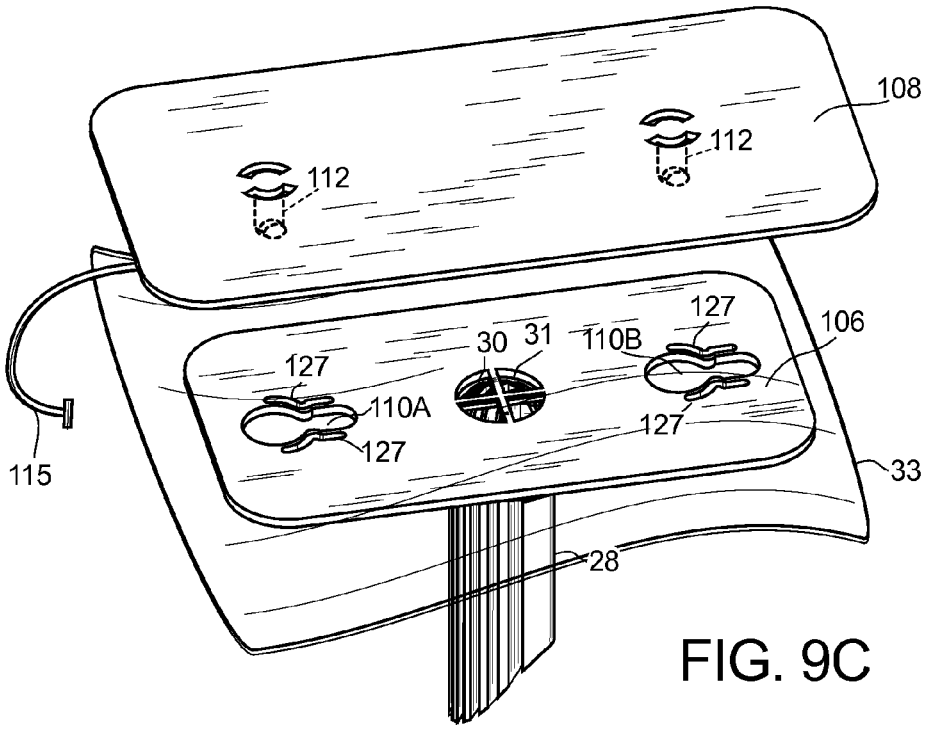
Figure 9D:
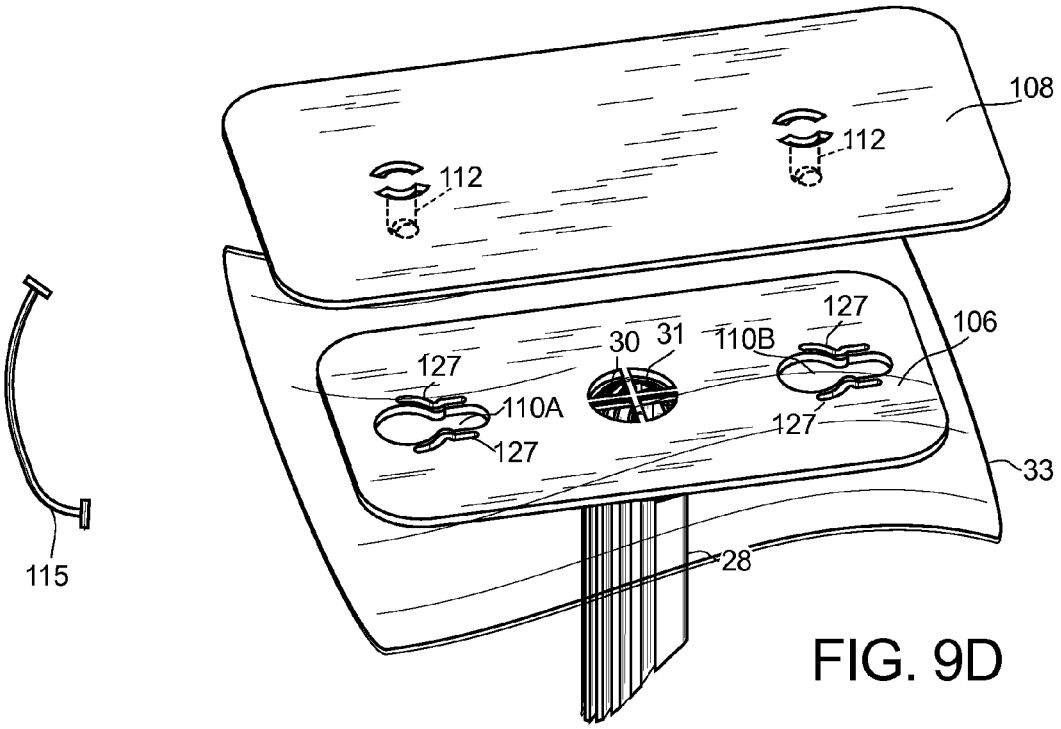

FIGS. 9A-9D are perspective views of different configurations of the coupling device of FIG. 7, including a retaining device or tether 115 for tethering the clip 108 to the head 106 when the clip 108 is disengaged from the head 106. In FIG. 9A, the clip 108 is tethered to the head 106 by tether 115. In FIG. 9B, curtain material 33 is positioned between the head 106 and the clip 108. In this case, the tether 115 is detached from the clip 108 and is only connected to the head 106. Detachment of the tether 115 allows for the coupling device of the partition mount to be attached to a central portion of the curtain, rather than at an edge portion of the curtain. In FIG. 9C, the tether 115 is detached from the head 106 and is only affixed to the clip 108. In FIG. 9D, the tether 115 is detached from both the head 106 and the clip 108.

Figure 10A:
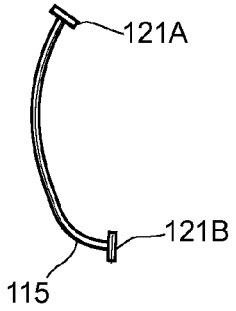
FIG. 10A is an illustration of the tether of FIGS. 9A-D.
Figure 10B:
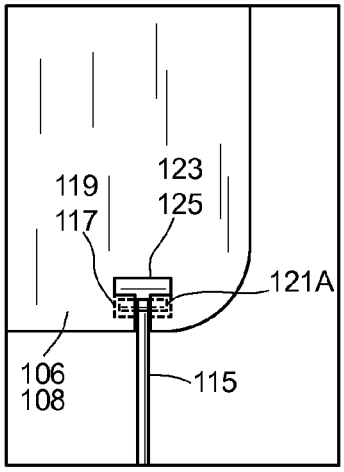
FIG. 10B is a close-up view of the interface of the tether key, as inserted in the keyed slot of the head and/or clip, in accordance with the present invention.

FIG. 10A is an illustration of the tether 115 of FIGS. 9A-D. In this embodiment, the tether 115 is in the form of an elongated and flexible cord, strand, or wire and includes T-shaped ends or keys 121A, 121B at first and second ends. In one embodiment, the tether comprises a strip of nylon material. FIG. 10B is a close-up view of the interface of the tether, as inserted in the keyed tether slot of the head 106 and/or clip 108, in accordance with the present invention. The T-shaped key 121A of the tether 115 is inserted within the T-shaped keyed tether slot 123, 125. The T-shaped tether key 121A is seated and retained within a seat 119, 117 of the tether slot 123, 125. In one embodiment, the T-shaped tether key 121A is formed of an elastically deformable material, and is press fit into the seat 119, 117 by the installer.

Figure 10C:
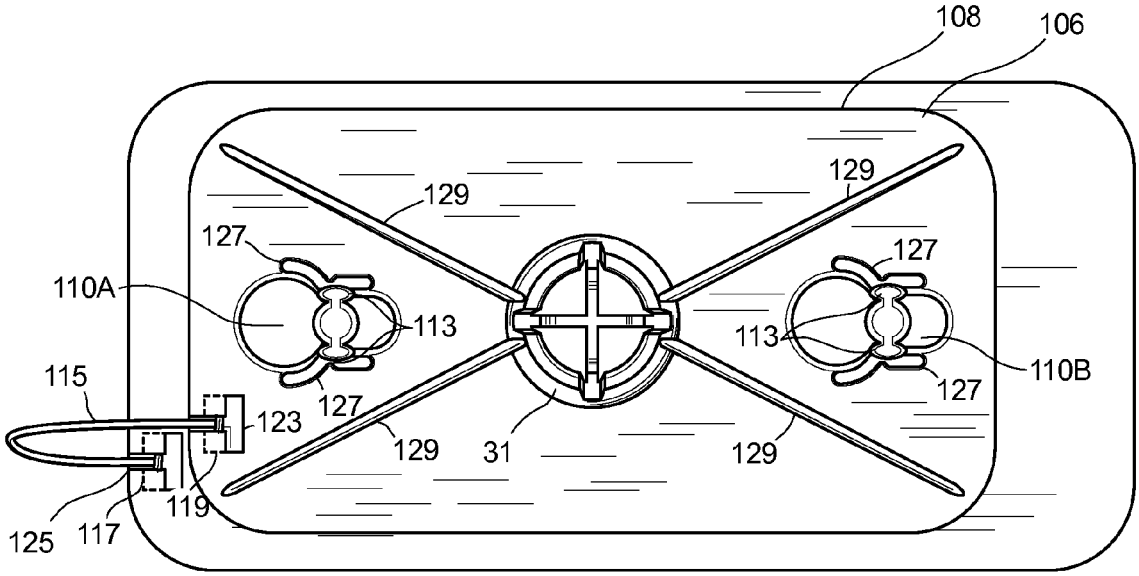
FIG. 10C is a bottom view of the head and the clip in a coupled relationship, illustrating the operation of the tether, in accordance with the present invention.

FIG. 10C is a bottom view of the head 106 and the clip 108 in a coupled relationship, illustrating the operation of the tether 115, in accordance with the present invention. In FIG. 10C, the tether 115 is coupled to both the head 106 and the clip 108. Retaining knobs 113 are visible in this view, and prevent vertical release of the clip 108 from the head 106. Each of the head 106 and clip 108 includes a keyed tether slot 123, 125. The keyed tether slots 123, 125 each have a T-shaped opening and a corresponding seat 119, 117 that extends into the body of the respective head 106 and clip 108. The corresponding T-shaped keys 121A, 121B of the tether 115 are positioned in the T-shaped openings of the keyed tether slots 123, 125 and are seated into the seats 119, 117. In this manner, the tether 115 is mounted to both, or either, of the clip 108 and head 106.

In another embodiment, the head 106 and/or clip 108 can be tethered to the plunger 28 or pole 20, or other component of the curtain mounting system by a tethering mechanism.

Figure 11A:
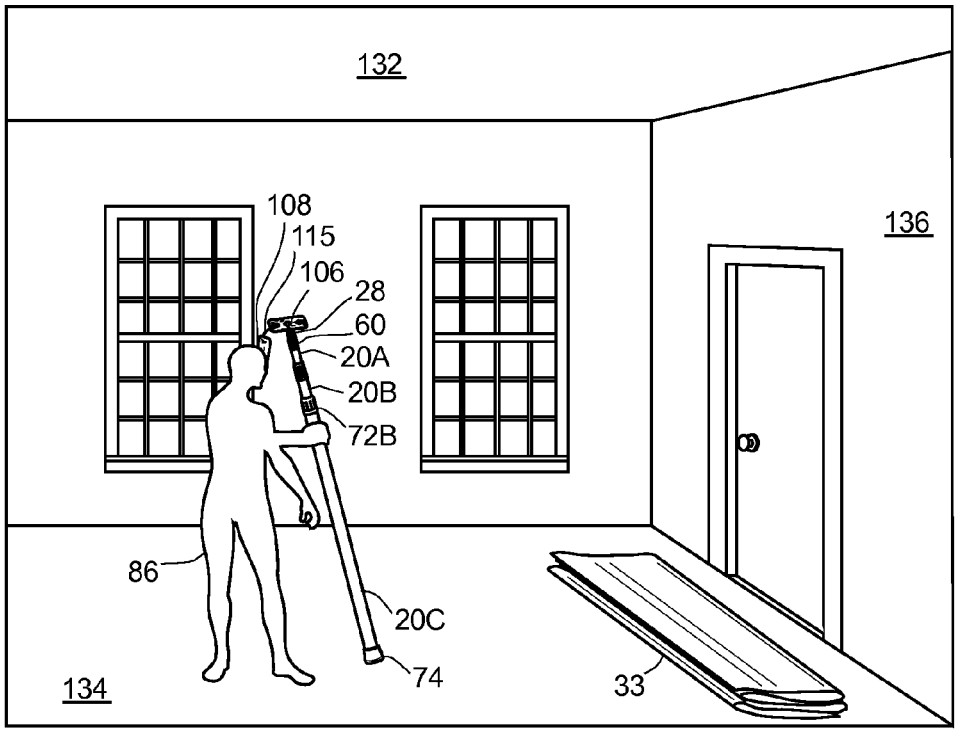
FIGS. 11A-11E illustrate an installation procedure of the curtain mounting system in accordance with the present invention.

FIGS. 11A-11E illustrate a method for installing a curtain in accordance with the present invention. In FIG. 11A, an installer 86 decides which portion of the room to partition. The room includes a ceiling 132, a floor 134 and a sidewall 136. The installer 86 selects a curtain 33 of appropriate size and selects one or more curtain mount extension poles 20 with integrated plunger assemblies. The clip 108 is attached to the head 106 by a tether 115.

Figure 11B:
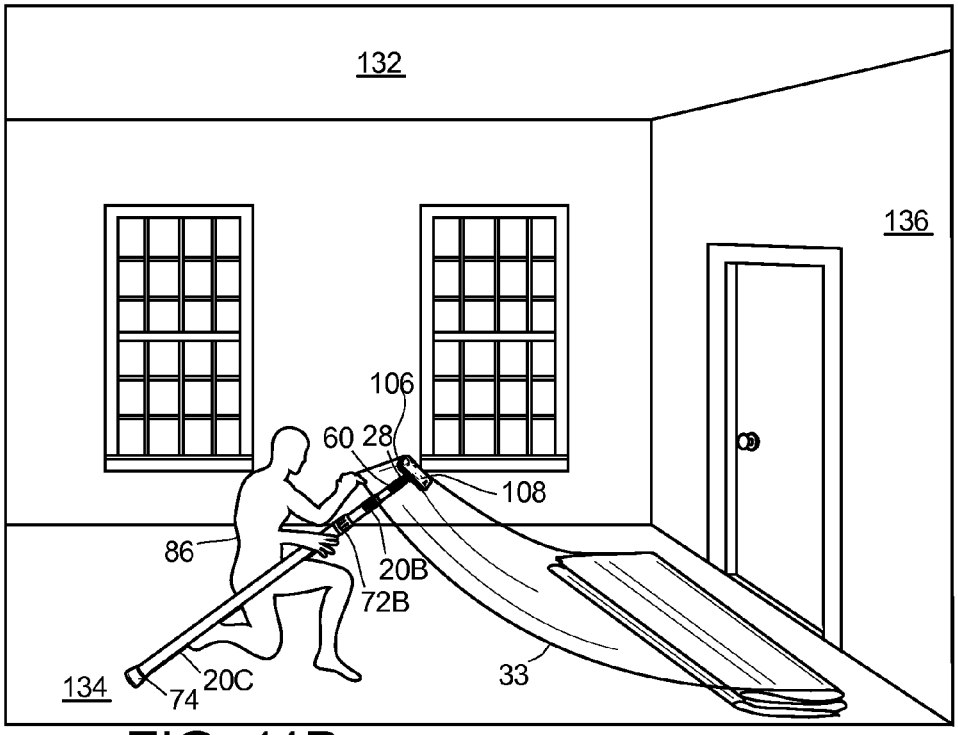

In FIG. 11B, the installer 86 mounts the curtain 33 to a head 106 using a clip 108 before raising the curtain 33. The curtain 33 is secured to the head 106 with the clip 108, for example in the manner described above in FIGS. 7-10. If a central portion of the curtain 33 is secured by the head 106 and clip 108, then the tether 115 can be removed.

Figure 11C:
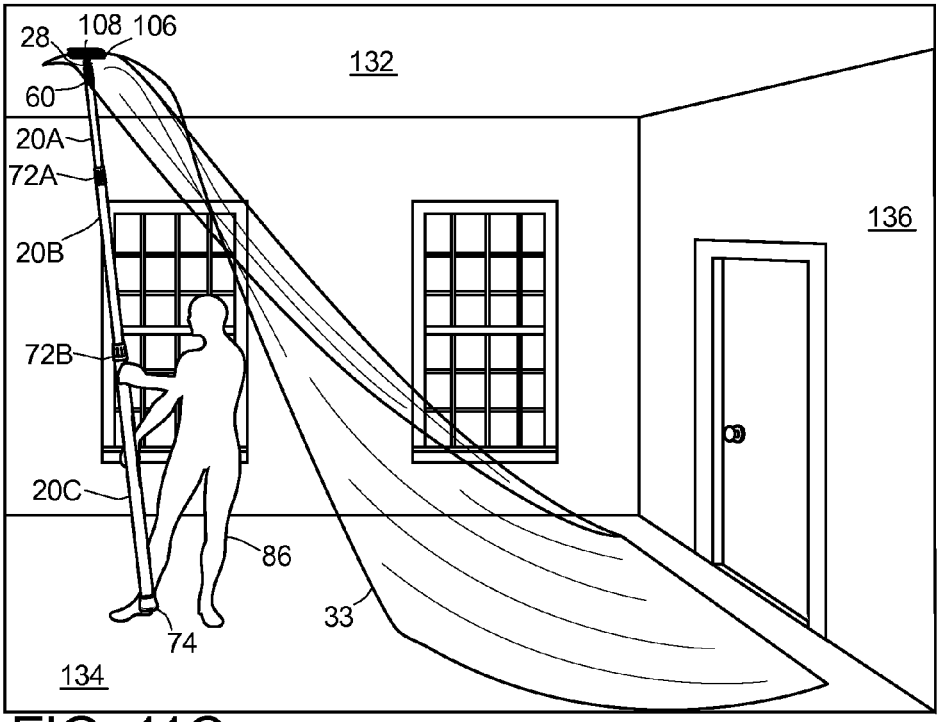

In FIG. 11C, the curtain 33 is raised to the ceiling 132 using the extension pole 20, the integrated plunger assembly, the head 106, and the clip 108. The pole 20 is adjusted in length and is positioned appropriately and the installer 86 pushes the pole 20, head 106, clip 108 and curtain 33 against the ceiling 132 to compress the spring in the integrated plunger assembly, and to urge the curtain in place against the ceiling.

Figure 11D:
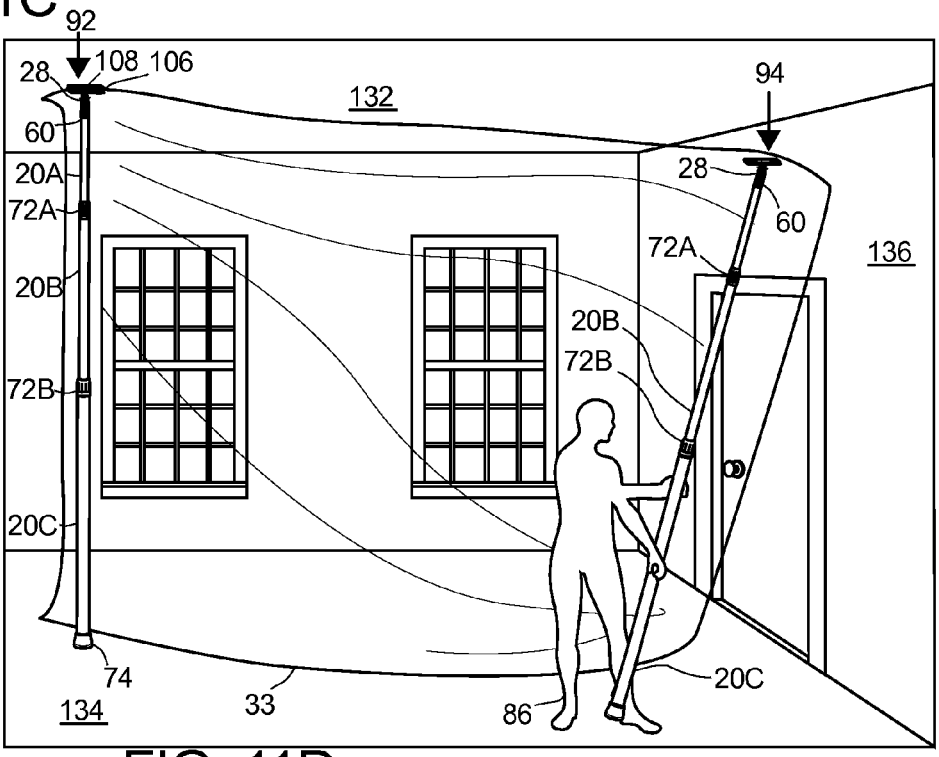

In FIG. 11D, a first mount 92 is shown in position with the head 106 urging the curtain 33 against the ceiling 132. Following this, a second portion of the curtain 33 is coupled to a second mount 94 and the second mount 94 is raised into position a few feet from the first mount 92.

Figure 11E:
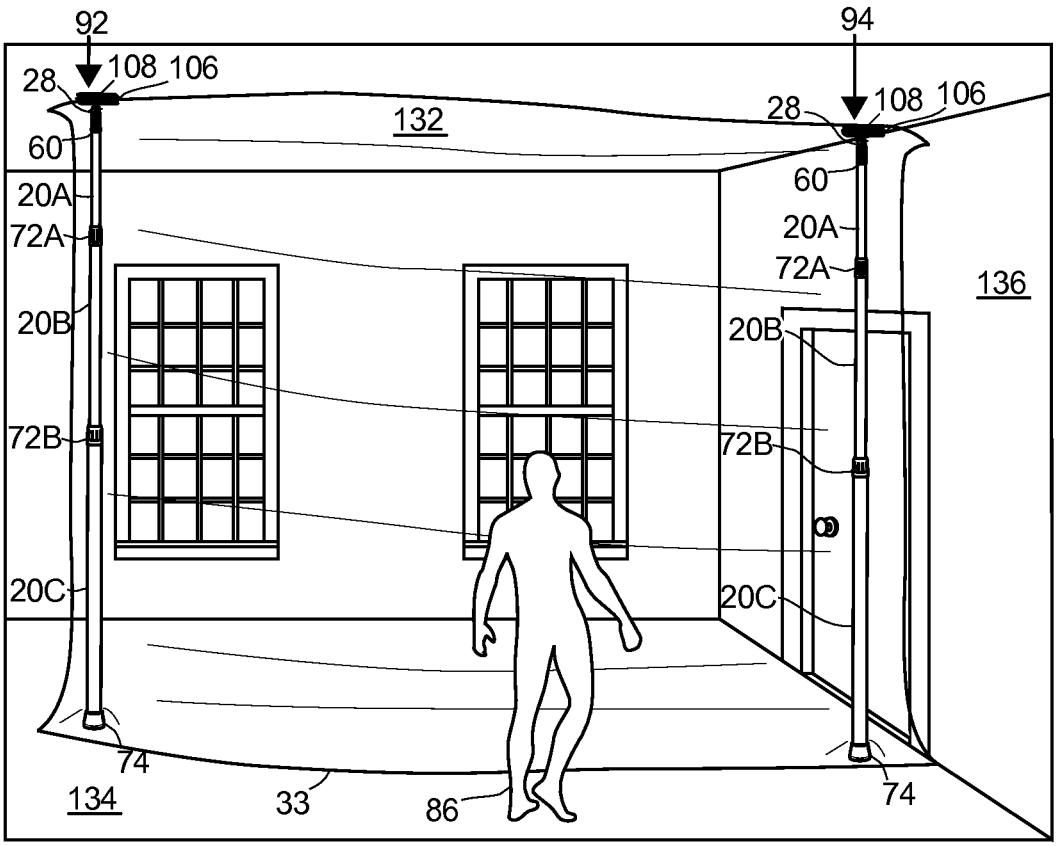

In FIG. 11E, the length of curtain 33 between the first mount 92 and second mount 94 is tensioned and the second mount 94 is placed. In this installation, lower portions of the curtain 33 are tucked under the rubber feet 74 to add tension to the curtain 33 and to secure the curtain 33 to the floor 134. Additional mounts may be added, depending on the application and the need for more complex or larger partition geometries.

Figure 12A:
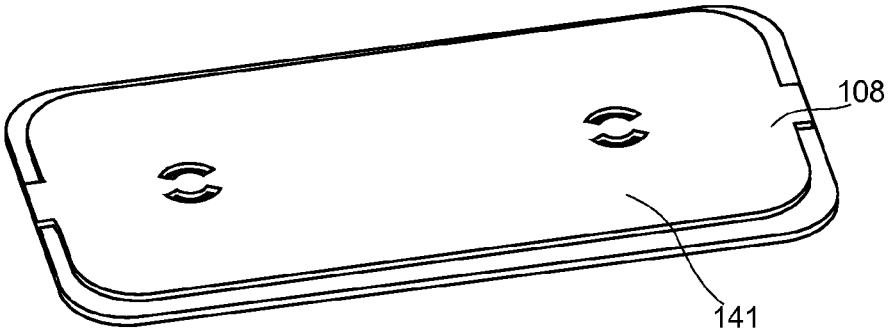
FIGS. 12A and 12B are perspective top and bottom views respectively of an embodiment of a clip having a high-friction upper surface, and a high-friction lower surface, in accordance with the present invention.
Figure 12B:
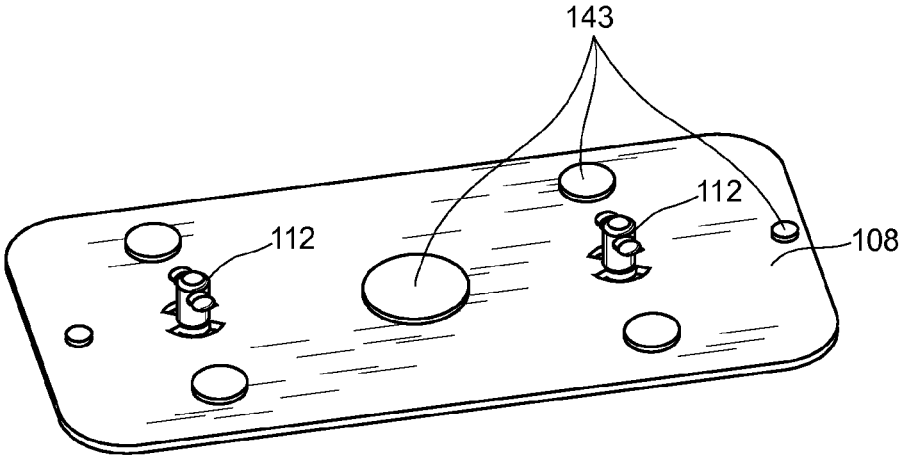

FIGS. 12A and 12B are perspective top and bottom views respectively of an embodiment of a clip having a high-friction surface, in accordance with the present invention.

Figure 12C:
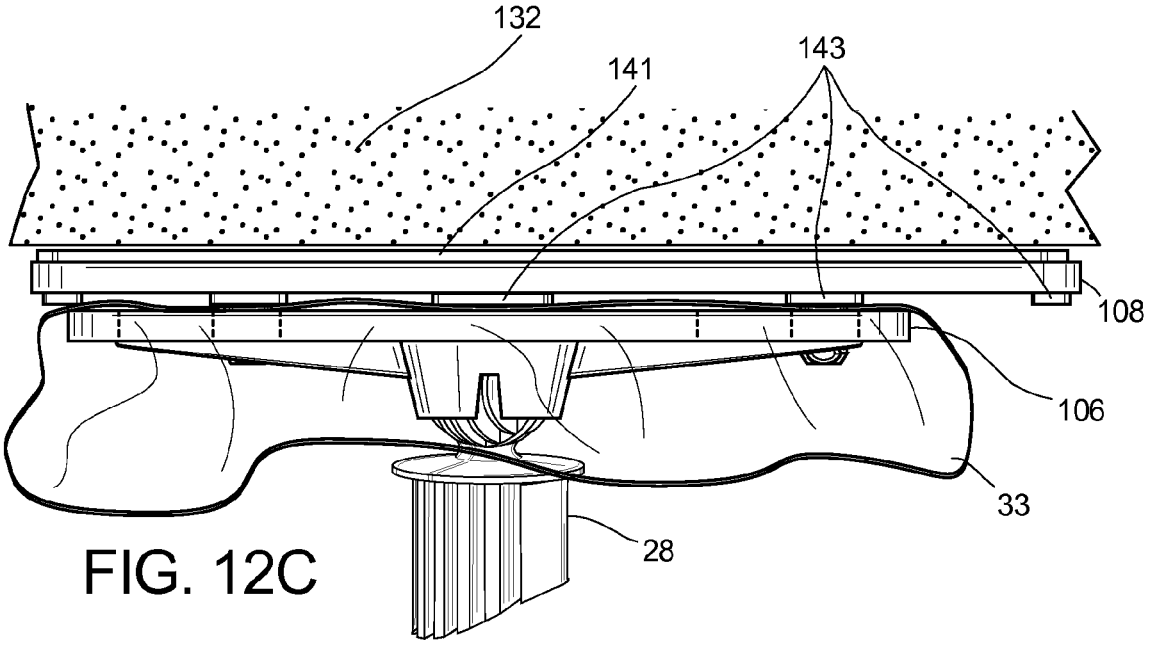
FIG. 12C is a side view of the clip of FIGS. 12A and 12B coupling a curtain to a head, in accordance with the present invention.

FIG. 12C is a side view of the clip of FIGS. 12A and 12B coupling a curtain to a head, in accordance with the present invention.

With reference to FIG. 12A, the clip 108 can optionally include a high-friction-material surface pad 141, or multiple pads, at an upper surface thereof. The surface pad 141 operates as a point-of-contact for the curtain mounting system with an abutting mounting surface, such as a ceiling of a room. In this manner, the surface pad 141 provides a high-friction interface between the curtain mounting system and the abutting mounting surface, such as a ceiling of a room, to reduce the likelihood of the installed curtain mounting system slipping relative to the abutting mounting surface, and therefore, operating in conjunction with a high-friction material foot 74 (see FIG. 1) applied to the bottom end of the pole 20C, to provide lateral rigidity in the system. Preferably, the surface pad 141 is formed of a resilient, compressible, high-friction material such as rubber, foam, silicone-based material, or the like.

With reference to FIG. 12B, the clip 108 can optionally further, or alternatively, include a high-friction-material curtain pad 143, or multiple pads, at a lower surface thereof. The curtain pads 143 operate to prevent a curtain mounted between the head and clip 108 from slipping. Preferably, the curtain pads 143 are formed of a resilient, compressible, high-friction material such as rubber, foam, silicone-based material, or the like.

In the assembled side view of the clip and head system of FIG. 12C, it can be seen that pressure exerted by the outwardly biased plunger 28 operates through the head 106, curtain 33, curtain pads 143, clip 108, and surface pad 141. In this manner, the curtain 33 is retained between the clip 108 and head 106 by the force operating on the curtain pads, and the position of the mounting system relative to the abutting mounting surface is fixed by the force operating on the surface pad 141.

In one embodiment, the surface pad 141 and curtain pads 143 are formed at the same time in a molding process. Holes are formed through the body of the clip 108, for example holes that correspond to the position of the curtain pads. The clip 108 is placed in a mold that is patterned to define the surface pad 141 at a top portion and the curtain pads 143 at a bottom portion, and molten high-friction material, such as Versaflex™ sold by GLS Corporation, McHenry, Ill., USA, is injected into the mold and caused to flow through the holes. Upon curing, the unitary pad including the surface pad 141 and the curtain pads 143 is formed in a single step.

In another embodiment, the curtain pads 143 are provided on a top surface of the head 106, on the surface where the head 106 interfaces with the clip 108 at the curtain interface.

Figure 13A:
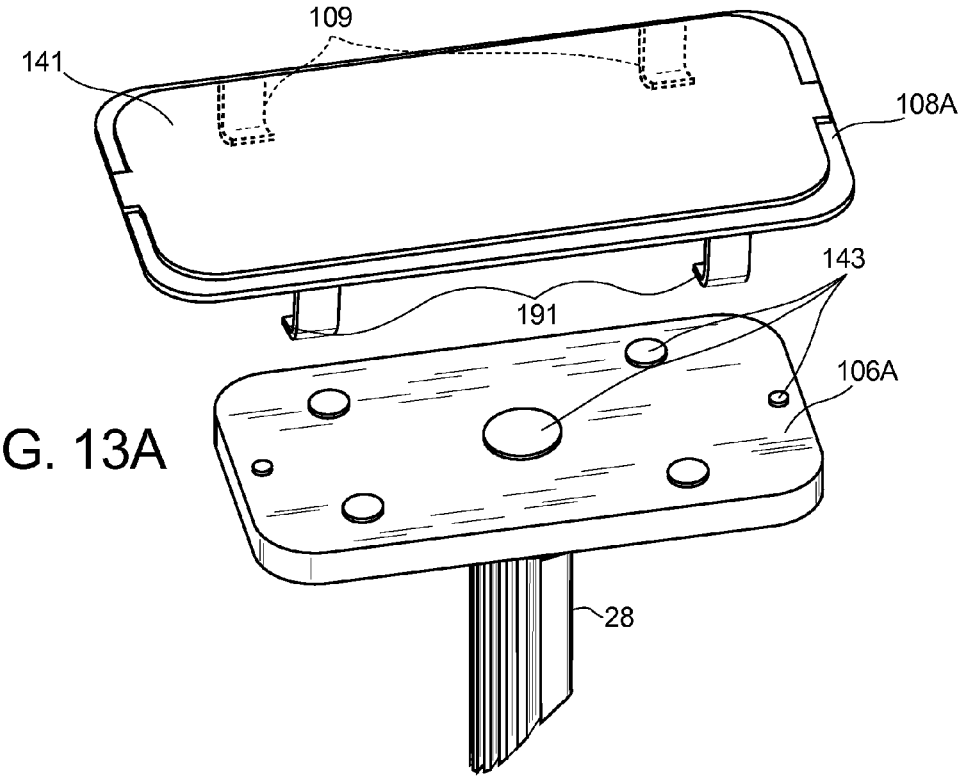
FIG. 13A is a perspective view of an alternative embodiment of a clip and head assembly, in accordance with the present invention.
Figure 13B:
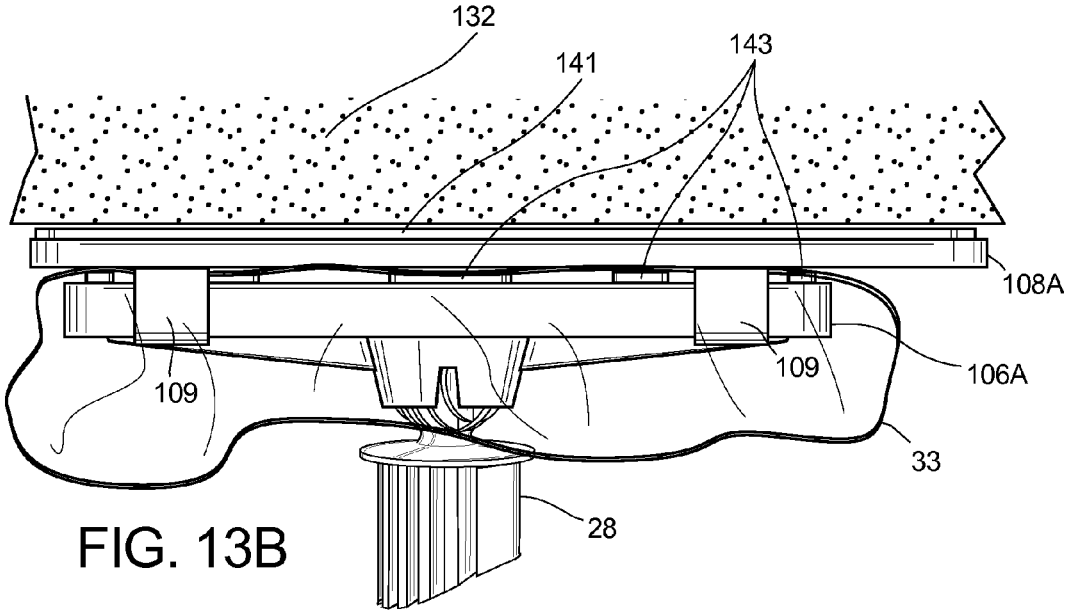
FIG. 13B is a side view of an assembled clip and head of FIG. 13A, coupling a curtain to the head, in accordance with the present invention.

FIG. 13A is a perspective view of an alternative embodiment of a head 106A and clip 108A assembly, in accordance with the present invention. FIG. 13B is a side view of an assembled clip and head of FIG. 13A, coupling a curtain to the head, in accordance with the present invention.

With reference to FIG. 13A, the head 106A includes a substantially planar upper surface. The corresponding clip 108A includes sets of opposed legs 109 that are configured to wrap around a side wall of the head 106A. The legs can be configured to snap onto the top of the head, or slide about an end of the head 106A. Tabs 191 on the legs 109 interface with a corner and underside of the head body 106A, securing the clip 108A to the head 106A. In this embodiment, the curtain pads 143 are provided on a top surface of the head 106A.

In the assembled side view of the clip and head system of FIG. 13B, it can be seen that pressure exerted by the outwardly biased plunger 28 operates through the head 106A, curtain pads 143, curtain 33, clip 108A, and surface pad 141. In this manner, the curtain 33 is retained between the clip 108A and head 106A by the force operating on the curtain pads 143, and the position of the mounting system relative to the abutting mounting surface by the force operating on the surface pad 141.

Figure 13C:
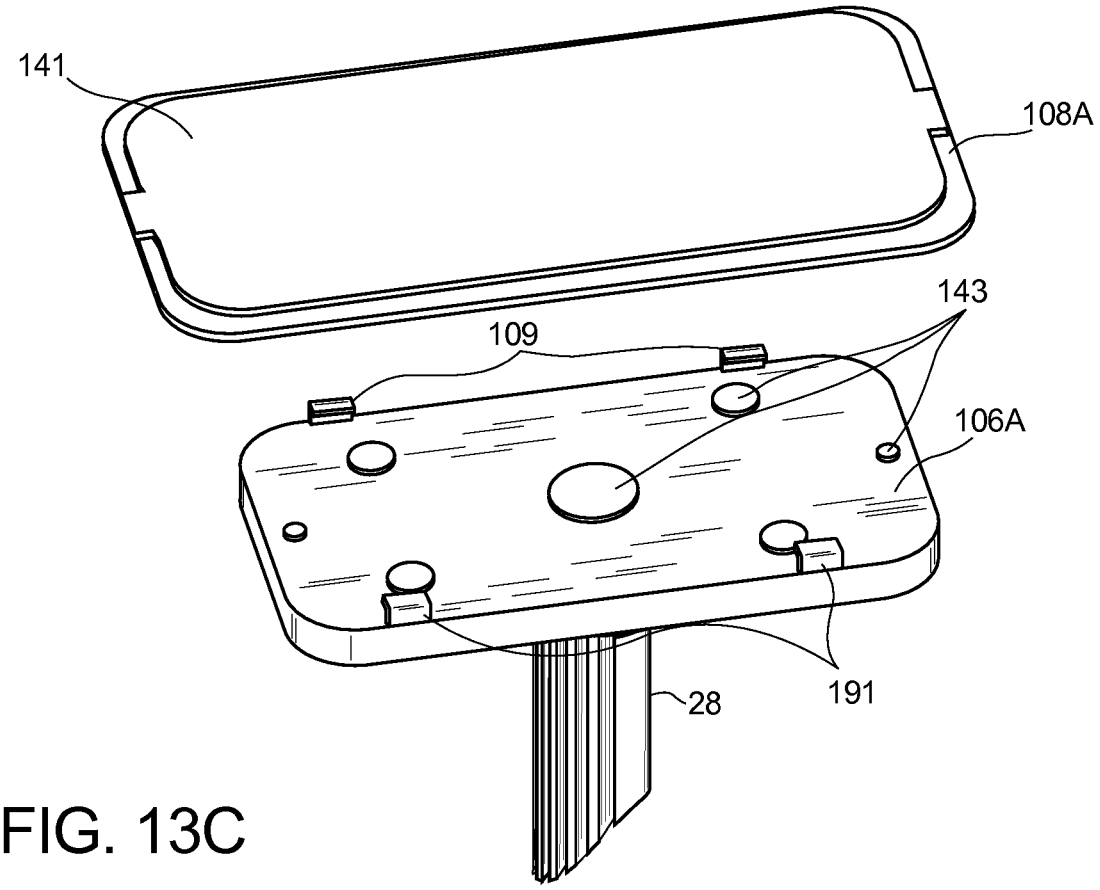
FIG. 13C is a perspective view of an alternative embodiment of a clip and head assembly, in accordance with the present invention.

In other embodiments, the legs 109 can be attached to the head 106A, and the clip 108A can be configured to receive and be secured to the head by the legs 109, as illustrated in FIG. 13C. Also, in other embodiments, the legs on one of the clip and head can be constructed and arranged to mate with a corresponding groove or other capture feature formed in the body of the other of the clip and head.

Other types of clips, heads, curtain mounting mechanisms, and the like are equally applicable to the present invention, including those clips, heads, and curtain mounting mechanisms disclosed in U.S. Pat. No. 5,924,469, U.S. patent application Ser. No. 10/600,939, filed Jun. 20, 2003, and U.S. patent application Ser. No. 10/600,300, filed Jun. 20, 2003, incorporated by reference above.

While this invention has been particularly shown and described with references to preferred embodiments thereof, it will be understood by those skilled in the art that various changes in form and details may be made herein without departing from the spirit and scope of the invention as defined by the appended claims.

What is claimed is:

1. A partition mount comprising:

an elongated adjustable-length pole having a foot end and a head end, the pole being adjustable in length between the foot end and the head end, the pole having a longitudinal axis, wherein the pole comprises an extension pole having multiple telescoping segments having different widths, and wherein the head end of the pole is at an inner segment of the extension pole and at a narrowest segment of the elongated adjustable-length pole;

an anchor having a portion secured to and within the narrowest segment of the elongated adjustable-length pole, the anchor at a position proximal to the head end of the pole;

a mounting head that extends from the head end of the pole and travels in a direction along the longitudinal axis of the pole relative to the anchor position within the narrowest segment of the pole, the mounting head including a neck having a portion that extends into an interior of the narrowest segment of the pole and a mounting unit that removably secures a sheet of material; and a compression mechanism between the mounting unit and the anchor that biases the position of the mounting head in an outward direction away from the anchor, wherein the anchor is constructed and arranged to limit outward extension of the mounting head in the outward direction, wherein the mounting head further includes a retainer that travels in relative motion with the mounting head in the direction along the longitudinal axis of the pole, wherein the anchor has a width less than an inner segment of the narrowest segment of the pole and the anchor makes contact exclusively with an interior of the narrowest segment of the pole and makes contact with an interior of a single telescoping segment; and wherein the retainer interfaces with the anchor at an interface position within the narrowest segment of the pole to limit the outward extension of the mounting head in the outward direction.

2. The partition mount of claim 1 wherein the retainer comprises a stop and the retainer prevents the mounting head from being released from the pole by controlling a travel distance of the mounting head.

3. The partition mount of claim 2 wherein the retainer comprises an elongated wire.

4. The partition mount of claim 2 wherein the anchor and retainer permit travel of the mounting head between a first position at which the compression mechanism is under a first compression and a second position at which the mounting head is at least partially in the pole and at which the compression mechanism is under a compression amount less than the first compression.

5. The partition mount of claim 1 wherein the extension pole further comprises a locking mechanism that secures the positioning of adjacent pole segments relative to each other.

6. The partition mount of claim 5, wherein the locking mechanism comprises an interior locking mechanism that fixes the respective lengths of the adjacent pole segments relative to each other.

7. The partition mount of claim 1 wherein the anchor is secured within the pole such that the narrowest segment of the pole slides freely relative to other segments of the pole.

8. The partition mount of claim 1 wherein the mounting unit comprises first and second portions that secure a sheet of material therebetween.

9. The partition mount of claim 8 wherein the first and second portions of the mounting unit extend in a direction that is transverse to the longitudinal axis of the pole.

10. The partition mount of claim 8 wherein the first portion includes at least one pin and wherein the second portion includes at least one aperture that receives the at least one pin.

11. The partition mount of claim 10 wherein the at least one aperture comprises a keyhole and slot, and wherein the mating at least one pin comprises a retaining knob, and wherein the first portion and second portion are secured by inserting each pin in a mating keyhole and sliding the pin from the keyhole and into the slot where the pin is retained in the aperture by the retaining knob.

12. The partition mount of claim 8 wherein the first portion comprises a head and wherein the second portion comprises a clip that is removably coupled to the head.

13. The partition mount of claim 8 wherein the first portion includes a plurality of legs that extend about at least one side surface of the second portion.

14. The partition mount of claim 13 wherein the legs further extend about a second surface of the second portion, the second surface being opposite a first surface of the second portion at which the second portion interfaces the first portion and an inserted sheet of material.

15. The partition mount of claim 8 further comprising a tether for coupling the first and second portions.

16. The partition mount of claim 15 wherein the tether is releasable from at least one of the first and second portions.

17. The partition mount of claim 15 wherein the tether comprises an elongated strap and wherein at least one end of the tether comprises a key and wherein a corresponding one of the first and second portions comprises a slot for removably receiving the tether key.

18. The partition mount of claim 8 further comprising a high-friction material applied to an upper surface of the second portion.

19. The partition mount of claim 8 further comprising a high-friction material coupled to at least one of the first portion and the second portion of the mounting unit at a position where the first portion and the second portion interface.

20. The partition mount of claim 1 wherein the compression mechanism comprises a spring.

21. The partition mount of claim 1 further comprising a pivot joint between the neck and the mounting unit to permit pivot of the mounting unit relative to the pole.

22. The partition mount of claim 1 wherein the anchor is secured to and within the pole by dimpling the pole body into the anchor.

23. The partition mount of claim 1 further comprising a dampener for dampening force imparted on the anchor by rapid release of the mounting head under bias by the compression mechanism.

* * * * *